US012404079B2

(12) United States Patent
Gonnert

(10) Patent No.: US 12,404,079 B2
(45) Date of Patent: Sep. 2, 2025

(54) MULTI-COMPONENT CLOSURE

(71) Applicant: Rosti Group AB, Malmö (SE)

(72) Inventor: Peter Gonnert, Ostheim (DE)

(73) Assignee: Rosti Group AB, Malmö (SE)

( * ) Notice: Subject to any disclaimer, the term of this patent is extended or adjusted under 35 U.S.C. 154(b) by 100 days.

(21) Appl. No.: 18/015,296

(22) PCT Filed: Jul. 12, 2021

(86) PCT No.: PCT/EP2021/069333
§ 371 (c)(1),
(2) Date: Jan. 9, 2023

(87) PCT Pub. No.: WO2022/008758
PCT Pub. Date: Jan. 13, 2022

(65) Prior Publication Data

US 2023/0271755 A1 Aug. 31, 2023

(30) Foreign Application Priority Data

Jul. 10, 2020 (DE) ..... 102020118295.3

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01); *B65D 2251/1008* (2013.01); *B65D 2401/30* (2020.05)

(58) Field of Classification Search
CPC ..... B65D 41/3428; B65D 55/16; B65D 2251/1008; B65D 2401/30
See application file for complete search history.

(56) References Cited

U.S. PATENT DOCUMENTS 3,741,421 A * 6/1973 Wittwer ..... B65D 41/0471 215/217
4,403,712 A 9/1983 Davila et al.
(Continued)

FOREIGN PATENT DOCUMENTS

CN 1271681 A 11/2000
CN 102733153 A 10/2012
(Continued)

OTHER PUBLICATIONS

International Search Report issued in corresponding International Application No. PCT/EP2021/069333 dated Nov. 23, 2021.

*Primary Examiner* — James N Smalley
(74) *Attorney, Agent, or Firm* — ArentFox Schiff LLP

(57) ABSTRACT

A Multi-component closure is proposed, which comprises a bottom part with a laminar support and a neck arranged thereto in one piece, which comprises a neck opening, a restring enclosing the neck and a first locking element, which is designed in between a neck opening and the restring. A screw cap is provided with a retaining ring and with a closure cap attached via a hinge to the retaining ring, where the retaining ring is kept rotatable by the restring, and where the closure cap comprises at least a second locking element, which in a closed state acts together with the at least one first locking element, to close the neck opening with the closure cap in a liquid-tight manner and that in the closed state a turn of the screw cap around the neck in a first direction causes an opening of the screw cap.

21 Claims, 14 Drawing Sheets

(56) References Cited

U.S. PATENT DOCUMENTS

Figure 1:
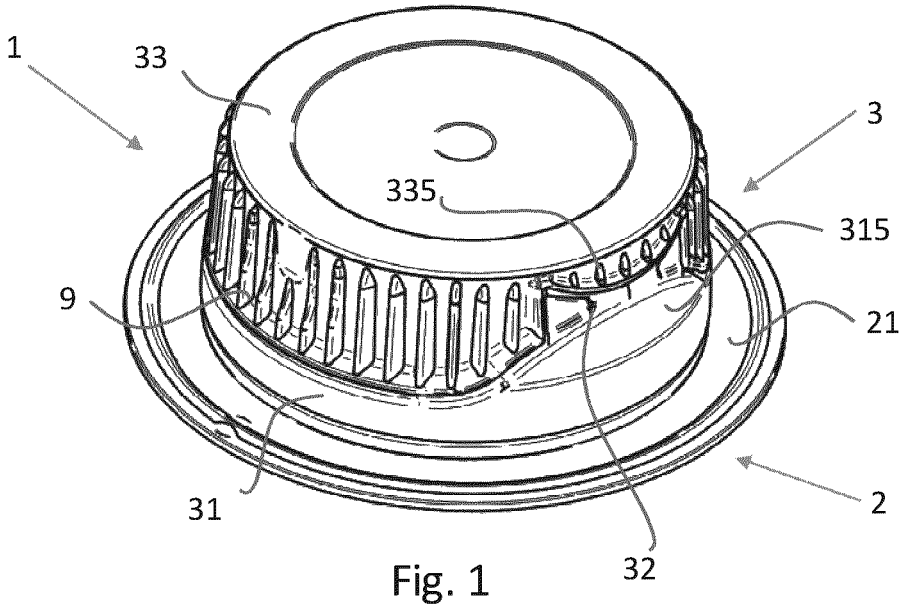

| | | | | |
|---|---|---|---|---|
| 9,108,774 | B2 * | 8/2015 | Kwon | B65D 41/3428 |
| 9,878,834 | B2 | 1/2018 | Azelton et al. | |
| 2013/0001185 | A1 * | 1/2013 | Antier | B65D 55/16 215/253 |
| 2018/0155094 | A1 * | 6/2018 | Loukov | B65D 47/0838 |
| 2019/0344933 | A1 * | 11/2019 | Kim | B65D 55/16 |
| 2022/0002021 | A1 * | 1/2022 | Krautkramer | B65D 55/16 |

FOREIGN PATENT DOCUMENTS

| | | | |
|---|---|---|---|
| CN | 113015683 | A1 | 6/2021 |
| DE | 7134891 | U | 1/2000 |
| DE | 202019106993 | U1 | 1/2020 |
| DE | 102020106661 | A1 | 9/2021 |
| EP | 3805126 | A1 | 4/2021 |
| EP | 3715276 | A1 | 6/2021 |
| EP | 3831736 | A1 | 6/2021 |
| EP | 3854717 | A1 | 7/2021 |
| WO | 2020239643 | A1 | 12/2020 |
| WO | 2020251984 | A1 | 12/2020 |
| WO | 2022008758 | A1 | 1/2022 |
| WO | 2022029110 | A1 | 2/2022 |

* cited by examiner

MULTI-COMPONENT CLOSURE

This application is a 35 U.S.C. § 371 National Phase of PCT Application No. PCT/EP2021/069333, filed on Jul. 12, 2021, which claims priority to German Patent Application No. 10 2020 118 295.3, filed Jul. 10, 2020, the disclosures of each of which are hereby incorporated by reference herein in their entireties.

The present disclosure claims priority form, DE application No 10 2020 118 295.3 dated Jul. 10, 2020, the content of which is incorporated herein by reference.

BACKGROUND

Liquids, in particular drinkable liquids can stored besides glass also in PET bottles and cardboard boxes. They have in some aspects a smaller ecological footprint and, for example, can be at least partly recycled. To close the packagings different closures are used. To reduce further the ecological footprint, the desire for different improvements exists, which on the one hand reduce the amount of material, but on the other hand also improve the recycling compatibility. This concerns not only the cardboard packaging and the packaging as such, but also the closures.

SUMMARY OF THE INVENTION

A multi-component closure is proposed here, which is provided amongst others for cardboard packagings, where cardboard packagings contain a liquid, in particular a cooled drinkable and perishable liquid. In one aspect, the multi-component closure comprises a bottom part with a laminar support and a neck arranged thereto in one piece. The neck can also be described as collar. The neck comprises a neck opening, a restring surrounding the neck and at least a first locking element. The latter is arranged between a neck opening and the restring. The multi-component closure further comprises a screw cap with a retaining ring and with a closure cap, which is attached via a hinge to the retaining ring. The retaining ring is arranged at least partly between support and restring around the neck in such a way, that it is kept rotatable around the neck but inseparable. An interaction between 2 Elements shall be understood under the term "inseparable" in the following disclosure, which can be separated with great exertion or damage and even destruction of at least one of the elements, respectively.

According to the proposed principal, the closure cap comprises at least a second locking element, which in a closed state interacts with the at least one first locking element, to close the neck opening with the closure cap in a liquid-tight manner. Furthermore, the screw cap is designed such, that in the closed state a turn of the screw cap around the neck in a first direction causes an opening of the screw cap.

With the proposed multi-component closure, it is achieved, that even after multiple opening and closing of a container all elements of the screw cap stay coupled with the bottom part and an easier disposal together with the packaging is enabled in such a way. Since the closure cap stays coupled with the bottom part, both elements can be disposed together. The closure according to the invention can be put on a cardboard packaging and be welded with to the package. However, the closure can be put on a film bag or used together with this. As well through the closure either liquids can be poured or solids as powder or granulate. Thus, the multi-component closure is suitable for a plurality of paper- or plastic-based packagings as well as for different filling materials.

In one aspect the retaining ring is connected to the closure cap via a plurality of predetermined braking points forming connecting webs, such that a visual evidence for an opening of the closure is caused in this way. Moreover, to safely and in particular inseparably in the above-mentioned sense couple the retaining ring with the bottom part, it can be provided in one aspect, to design the restring with its side facing the laminar support essentially parallel to the support. The side facing away from the laminar support can extend obliquely to the support. Thereby the parallel side of the restring provides an effective boundary of the retaining ring and prevents a stripping-off or generally a displacement of the ring in direction of the neck opening, the so-called z-direction. Between support and restring can be sufficient space, such that the retaining ring comprises a slight play in z-direction. Thereby the retaining ring is arranged though rotatably but still not displaceable.

In a further aspect the retaining ring comprises a multitude of retaining elements, which are designed, to keep in collaboration with the restring the retaining ring essentially inseparable rotatable around the neck. The retaining elements can be attached at one end pivotally to the retaining ring and face with its other end the side of the restring facing the laminar support. Optionally a swivel axis of the retaining elements can face the laminar support. In the intended use, in particular in the production the retaining ring is slided from the neck opening over the restring, such that the retaining elements are first pressed through the restring on the retaining ring, and as soon the retaining ring is completely slided over the restring, engage along the side facing the support.

In a further aspect the first locking element comprises at least one male thread segment with a first pitch. The second locking element has at least one female thread segment with a second pitch. First and second pitch can be different. In particular, the second pitch is slightly smaller than the first pitch, such that in the closed state a force is exerted on the closure cap by the interengagement of the threads, which closes the neck opening with the closure cap in a liquid-tight manner.

In an embodiment 4 to 6 male thread segments are provided for the first locking element and 2 female thread segments for the second locking element. The female threads with respect to a respective axis of symmetry through a midpoint of the closure cap are arranged essentially rectangularly to the hinge and/or facing each other.

Alternatively, the at least one first locking element can comprise a male thread segment and the at least one second locking element a female thread segment, where the female thread essentially is arranged oppositely the hinge.

The length of the male threads as well of the female threads depends on the number of the respective threads. Generally, for several male thread segments these can correspond to the 0.25 to 0.45 times of a circumference of the neck, in particular in the range from 0.27 to 0.35 times of a circumferences of the neck. For a single male thread, the length can also correspond to the 0.8 to 1,8 times of a circumference of the neck. In a similar way a length of the female thread essentially can correspond to the 0.1 to 0.3 times, in particular in the range from 0.1 to 0.15 times or also the 0.33 to 0.66 times, in particular in the range from 0.55 to 0.65 times of the circumference of the inside of the closure cap, at which the female thread is arranged. Generally, the length and the pitch are chosen such, that the force generated in the closed state by the threads closes the opening effectively.

In a further aspect the one first locking element comprises at least one connection male thread segment, which follows the at least one male thread segment and which is designed, to guide on a rotational movement of the closure cap the at least on female thread segment in the male thread segment when. Thereby a "gripping" of the female thread segment in a closing of the opening by the closure is made easier. For this purpose, it can be provided, that a pitch of the connection male thread segment differs from first pitch, in particular is smaller than the first pitch. For example, the pitch of the connection male thread segment can correspond to the second pitch, i.e. the pitch of the female thread segment. Alternatively, the pitch of the connection male thread segment can change. Also, thereby a gripping and guiding of the female thread segment can be improved and the feeling, when the closure grippes, can be conveyed to the user.

For a further improvement of a haptic impression and to prevent an unintended opening near the respective ends a latch cam can be provided in the male thread segment. This is designed to engage in a closed state of the closure cap in a notch in the female thread. Thereby, the user is on the one hand a "closing" indicated by means of a haptic feedback, on the other hand an unintended opening is prevented. Alternatively, the latch cam can also be located at the female thread and the notch at the male thread segment.

In another embodiment the first locking element and the second locking element form a bayonet lock. In one aspect hereto, the at least one first locking segment comprises a plurality of longitudinal slots, at the respective end of which following a transversal slot in a rectangular manner. The at least one second locking element comprises a plurality of knobs, which are arranged such, that they engage during a defined longitudinal and subsequent rotational movement of the closure cap in a the first direction opposite second direction in the longitudinal and dedicated transversal slots. Thereby the closure cap can be effectively closed with the bayonet lock and easily be reopened. The plurality of longitudinal slots can be arranged symmetrically around the neck. In an embodiment, 2 longitudinal slots are provided with a transversal slot following each in a rectangular manner, where the knobs are arranged with respect to a respective axis of symmetry through a midpoint of the closure cap essentially in a rectangular manner to the hinge. The transversal slots in turn can be arranged facing each other. In this embodiment a sufficient closure force is produced, which prevents an unintended opening. In another embodiment a knob is provided on the inside of the closure cap essentially opposite to the hinge.

Different embodiments concern the embodiment of the elements of the bayonet catch. In one aspect the plurality of longitudinal slots extends starting from the neck opening in direction towards the support. In addition, the plurality of longitudinal slots can open towards the neck opening, i.e. the longitudinal slots comprise a width, which at least corresponds right an extension of the knobs and optionally increases in the region of the opening. Thereby the knobs on the closure cap can be more easily been "gripped" during a rotational movement for closing.

In a further aspect, the first locking element comprises a latch cam, which is arranged at an interface of the longitudinal to the transversal slot, such that is has a play, i.e. prevents in the closed state a rotation of the closure cap along the first or second direction. Thereby also with the bayonet lock, a liquid-tight cap is possible. Therefor it can be further provided, that the length of the knobs essentially corresponds a length of the transversal slots, such that the closure cap resp. the knobs of this are kept by the boundary of the cross section and the latch cam in a defined position, which intendedly can be changed by a user only with a defined force. Equally, a height of the knobs corresponds to a width of the one or the transversal slots.

Another aspect concerns the seal of the closure cap to achieve and ensure the liquid-tight seal. In one aspect, the closure cap comprises a sealing ring, which in a closed state of the closure cap engages in the neck opening in a liquid-tight manner. For this purpose, in embodiments an outer diameter of the sealing ring can be slightly larger than the neck opening. In addition, the neck opening can comprise an inwardly curved flap, which is designed flexible, and thus completely flushes with the sealing ring.

To prevent by means of the closure cap, a canting during opening and closing of the neck opening, it is provided in some aspects, that the sealing ring comprises a height, which also increases with increasing distance to the hinge. In other words, the height of the sealing ring is not equal, but changes depending on position and distance from the hinge. By the height of the sealing ring the distance from the ferrule on the closure cap to the lower annular edge is understood, which in the closed state extends farthest in the neck. Thus, the sealing ring is in some aspects designed such, that with respect to a cross section along a plane extending through the hinge and the midpoint of the closure cap a segment of the sealing ring facing the hinge comprises a smaller height than a segment of the sealing ring facing away from the hinge. The different height causes an angle along this cross section with respect to an axis parallel to the closure cap, which is in the range from 1.5° to 5°, in particular ca. 1.7° to 2.3°.

In a further aspect, a side of the sealing ring facing the neck opening is shorter than an inner side of the sealing ring. Thereby it is achieved upon closing, that the sealing ring scrubs along the neck opening, such that, in particular with the different radii of ring and neck opening a tightness is achieved. The same time it is prevented, that the sealing ring cants upon closing.

Other aspects concern the hinge, which in one embodiment comprises a butterfly hinge. The hinge comprises in some aspects a flexible joint arranged between retaining ring and closure cap, which in particular is designed as one piece with the retaining ring and the closure cap. This allows to produce the screw cap in an injection molding process, where in particular for the individual elements of the closure the same materials can be used. The hinge can comprise a first hinge flap, which forms a part of the retaining ring. A second hinge flap in turn forms a part of the closure cap, where the joint is arranged between both flaps. In the region of the hinge the retaining ring or more precisely the first hinge flap, thus, can also be arranged above the restring. Also, this aspect contributes to an improved opening and closing and reduces the danger of a canting during closing.

In a further aspect, the hinge is configured to keep the closure cap in an open state in an angle of at least 90° rotated around the hinge in the closed state, and in particular in the range from 115° to 145°, in particular, however, larger than 120° rotated around the hinge. In other words, the hinge is configured to exert a force on the closure cap upon passing a defined position after a rotation around the joint angle, such that this closure cap cannot be turned back over this position without exerting further force. Thereby it is ensured, that the closure cap in a state opened in such a manner also stays open and does not turn back unintendedly, for example, during pouring a liquid out of the cardboard packaging. In one aspect the hinge can thereto comprise at least a snap element, which is configured to keep upon passing of a predefined rotation angles of the closure cap around the flexible joint the closure cap above this rotation angle. The rotation can be in the range from 80° to 100° and in particular around 90°. Upon a rotation further than this angle, the closure snaps open and stays in the clapped open state.

In one embodiment, the snap element is attached to the retaining ring. Thereto in some aspects the at least one snap element can be located in a recess of the retaining ring, and an axis of rotation of the flexible joint extends above this recess. The at least one snap element can be pretensed, such that an opened state of the closure cap represents a relaxed state with respect to the pretensed state. In this connection also the closed state can represent a relaxed state. Thus, the snap element can be configured such, that during opening, i.e. the rotational movement of the closure cap around the joint it becomes increasingly tensed until a limiting point, which corresponds to the position described above. Exceeding this point the snap element snaps back again in a relaxed state, such that the closure cap stays open. This effect can be achieved by an element being under tension.

To prevent a canting during a closing or more precisely a re-closing, the axis of rotation of the flexible joint can be closer to a plane spanned by the neck opening than the first and second locking element. In other words, the joint (seen from the support), thus, is located above at least at the height of the first or second locking elements, respectively. In one aspect the flexible joint extends at a height of a lower edge of the sealing ring, i.e. at the height of the edge of the sealing ring, which faces the support.

In one embodiment, the neck opening comprises a smaller outer diameter than a bottom side of the neck, in particular in the region of the retaining ring. In addition, in some aspects the closure cap can comprise a fluting with vertically extending webs on its circumferential side flank. Thereby the closure cap can be better gripped, and a user can better control the force exerted to the cap. In addition, the number of the webs per unit length can differ. Thus, by the haptic impression a usage is further made easier.

SHORT DESCRIPTION OF THE FIGURES

Figure 2:
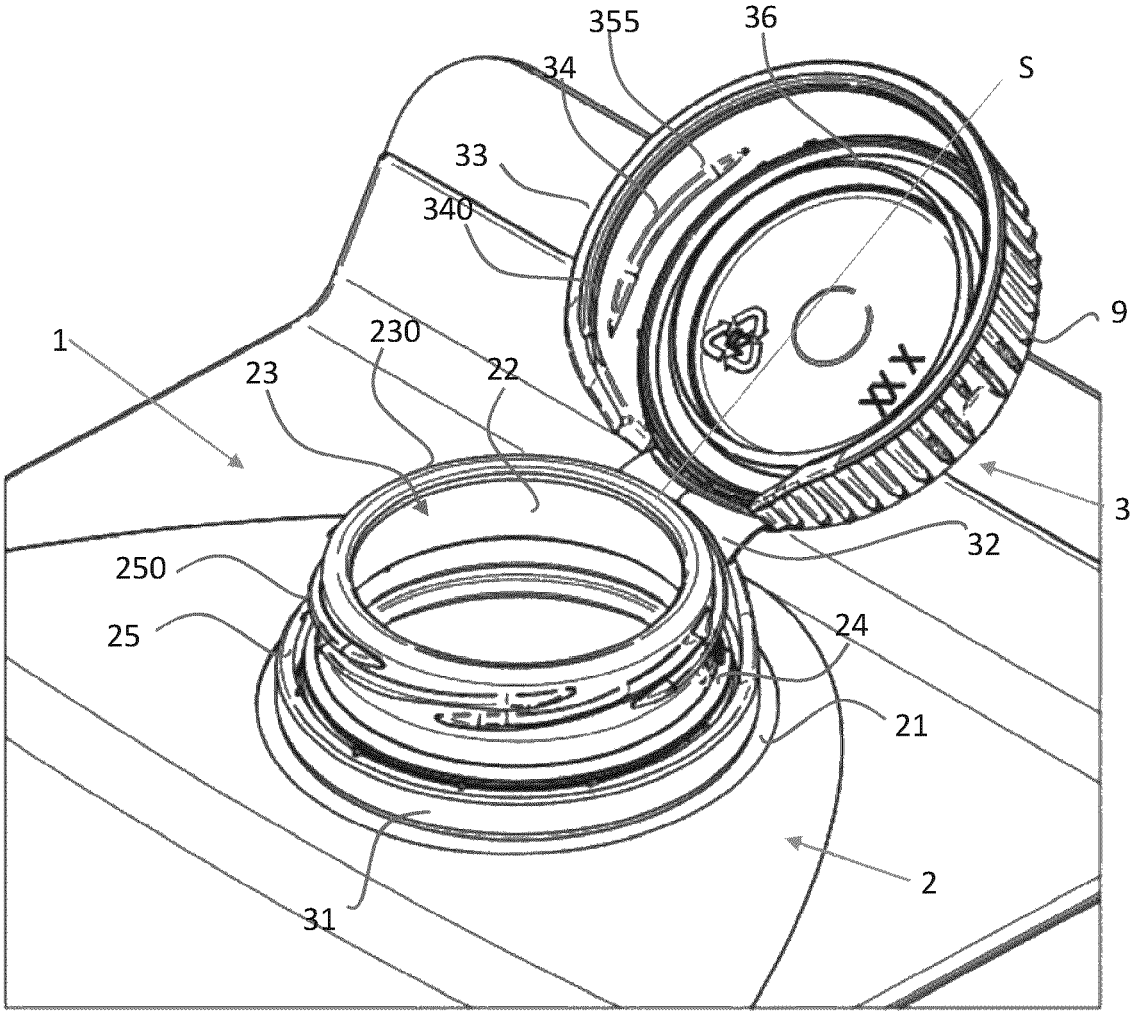
Figure 4A:
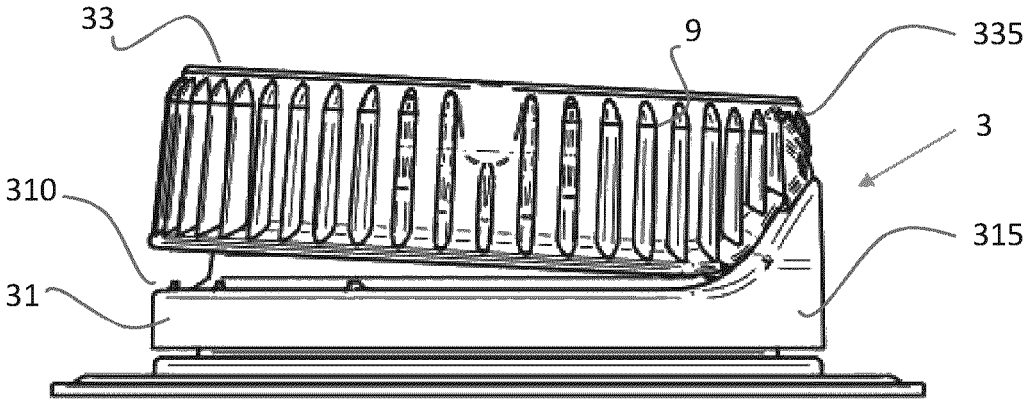
Figure 4B:
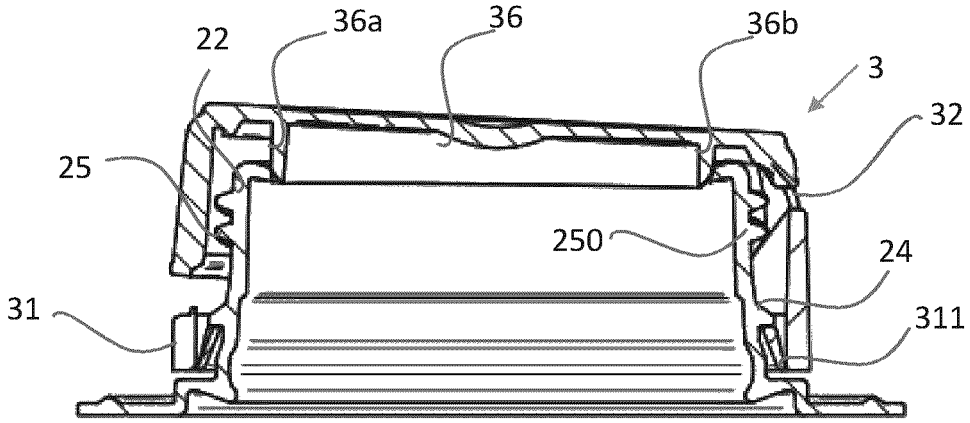
Figure 4C:
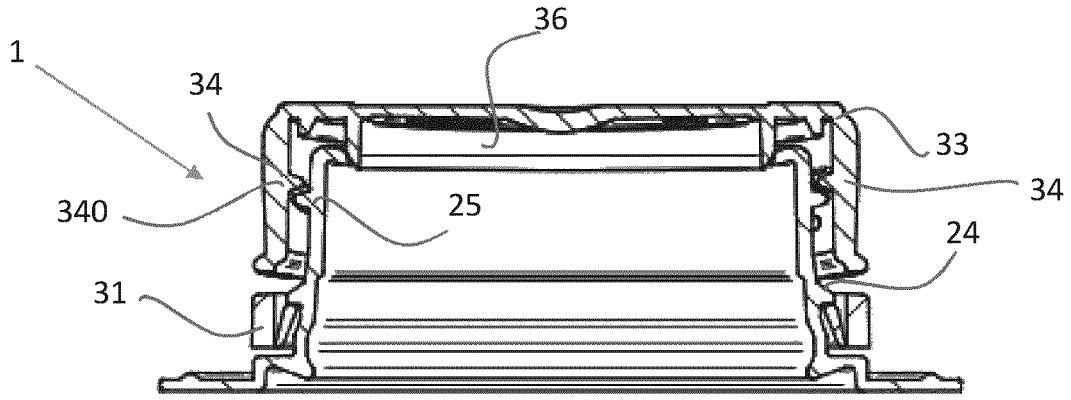
Figure 5A:
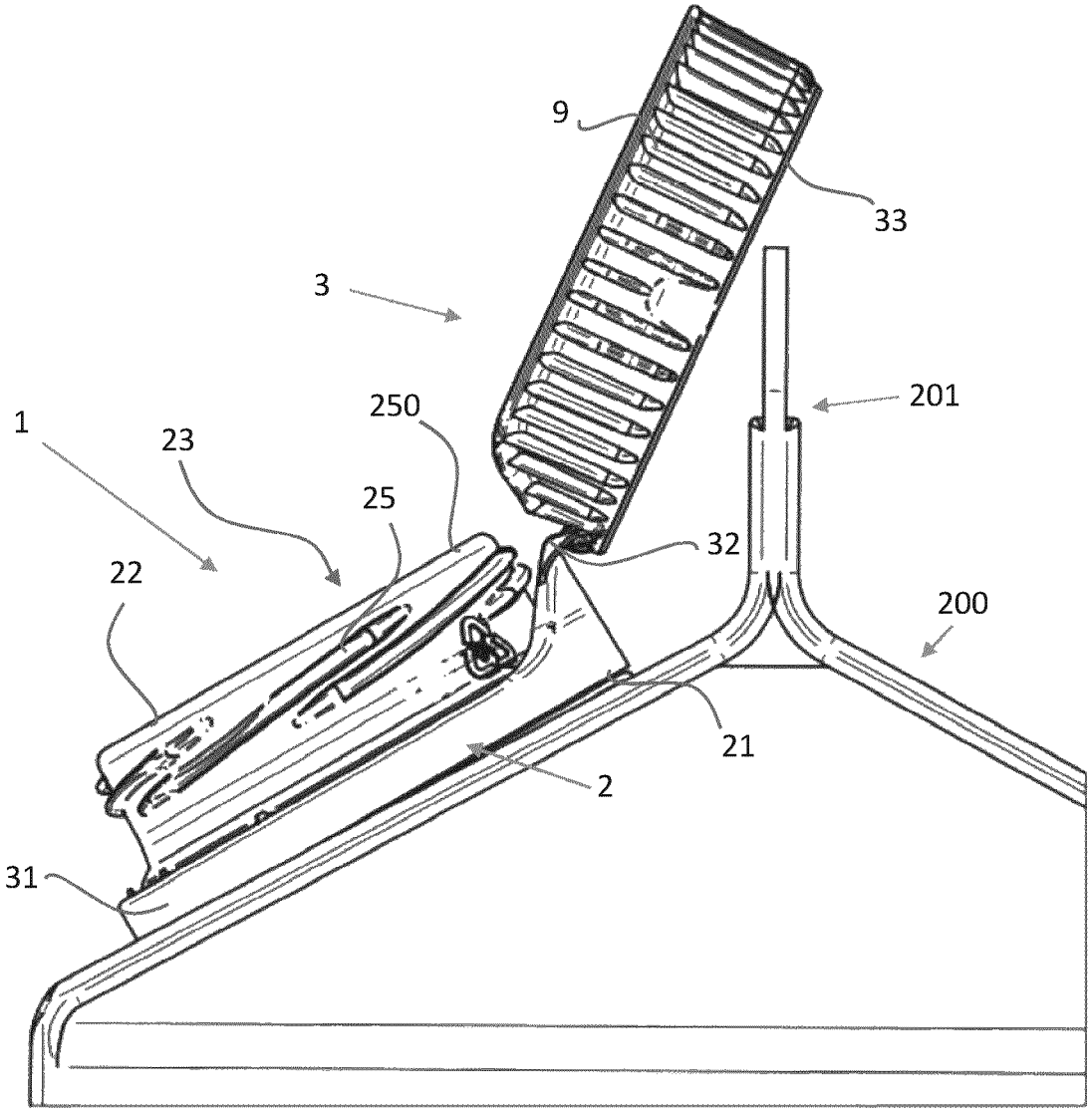
Figure 5B:
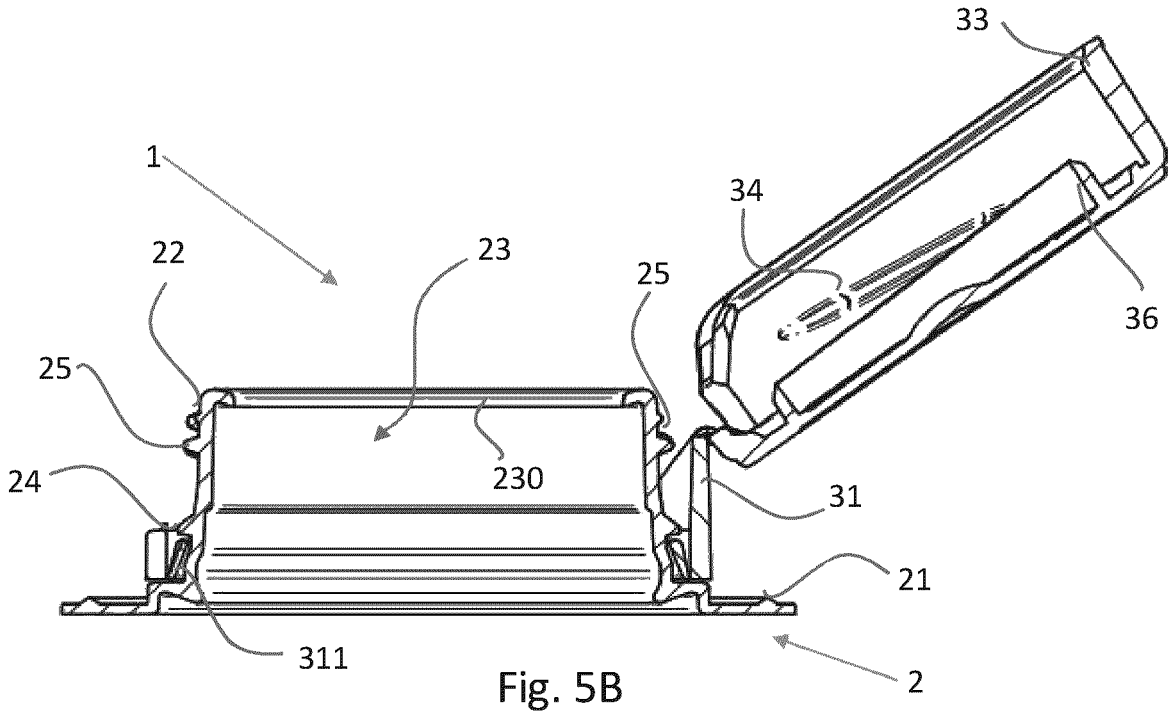
Figure 5C:
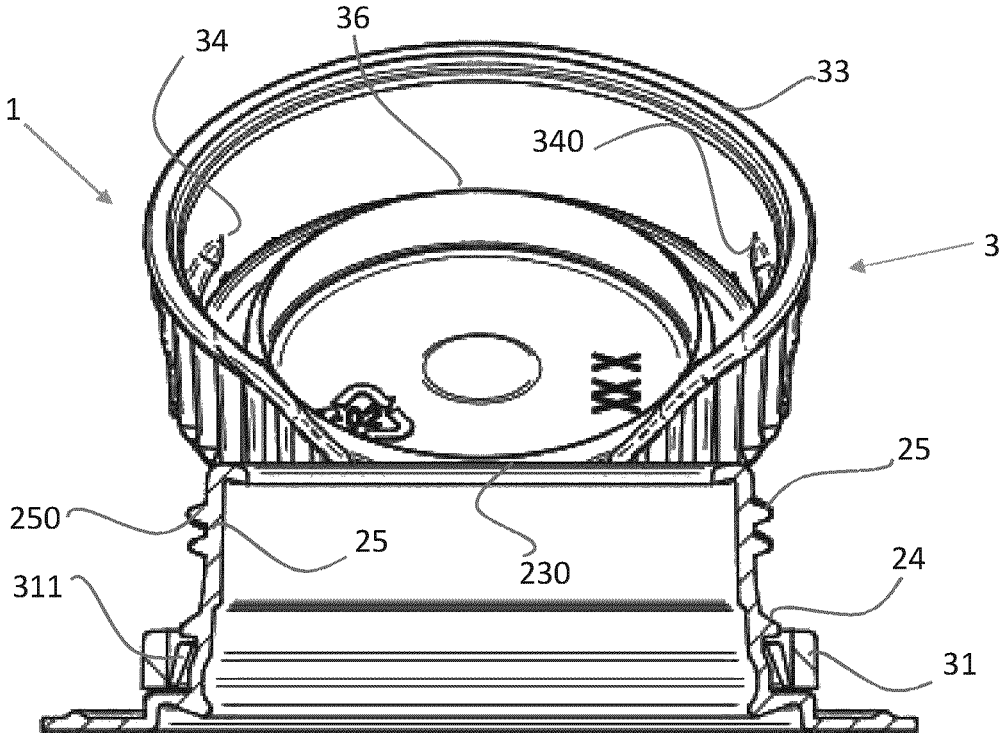
Figure 6:
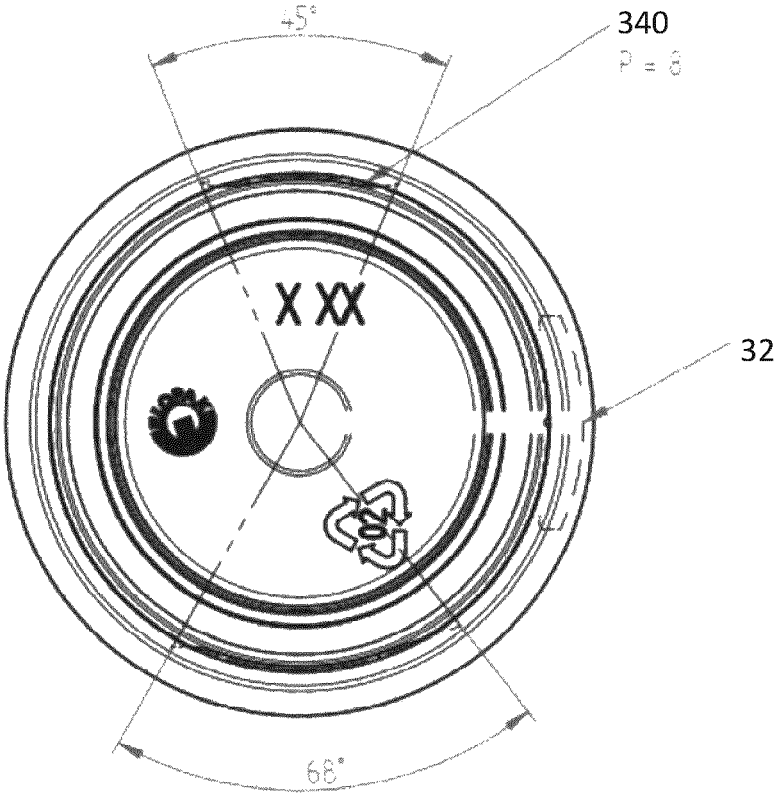
Figure 7:
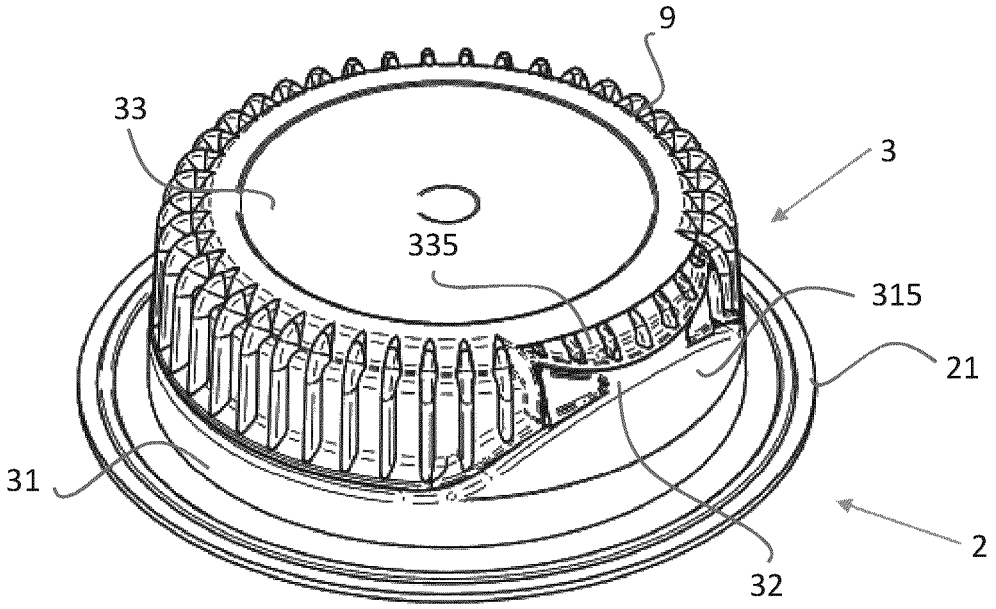
Figure 8:
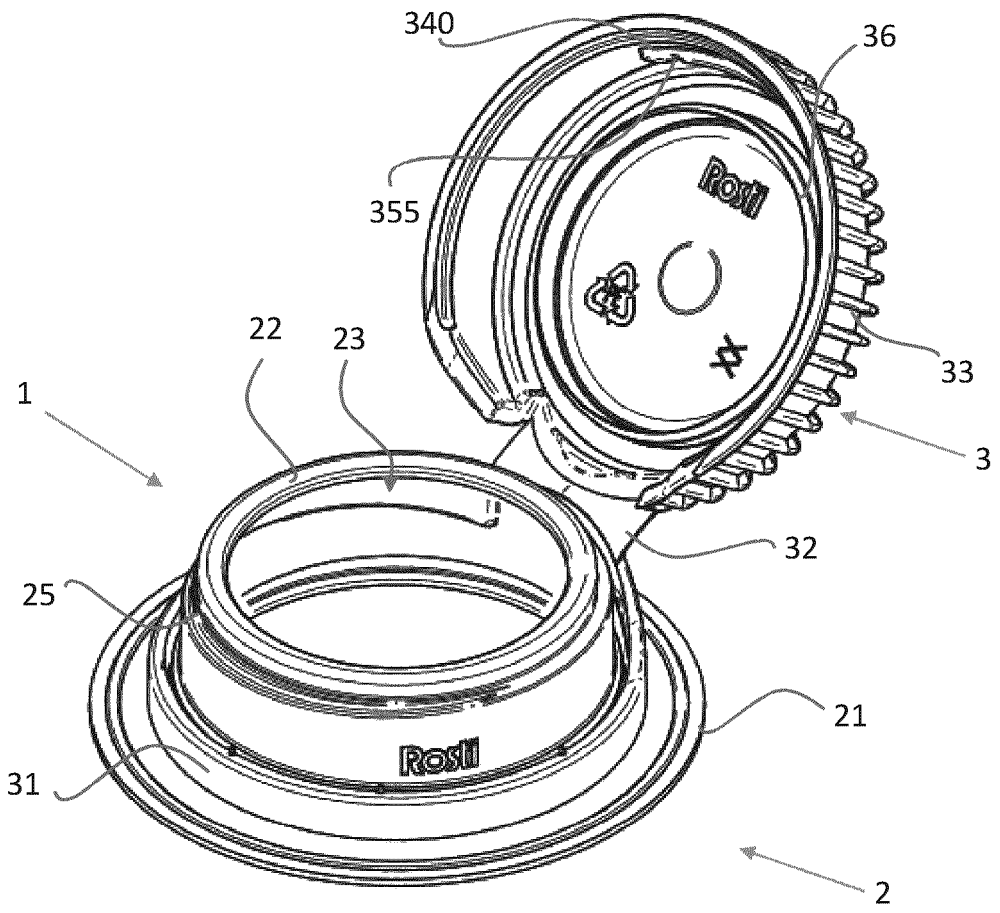
Figure 9:
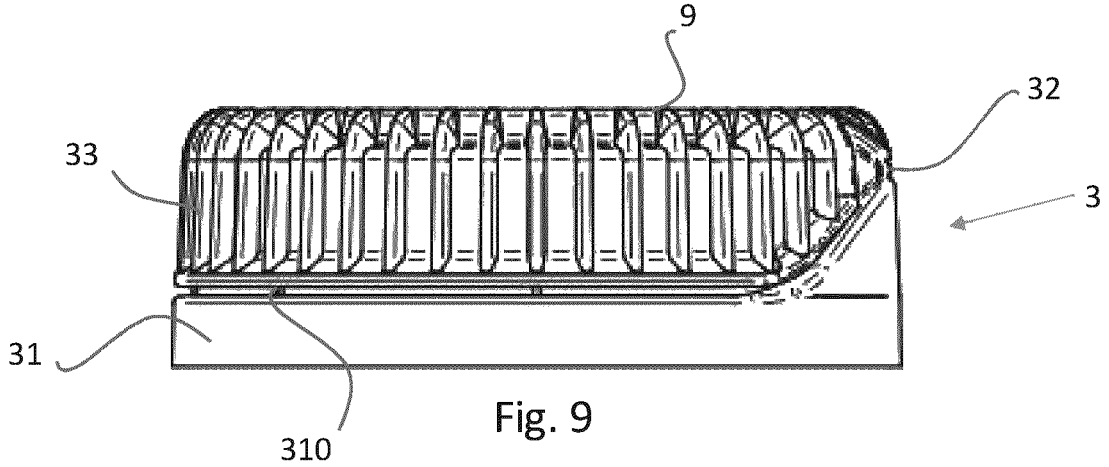
Figure 10A:
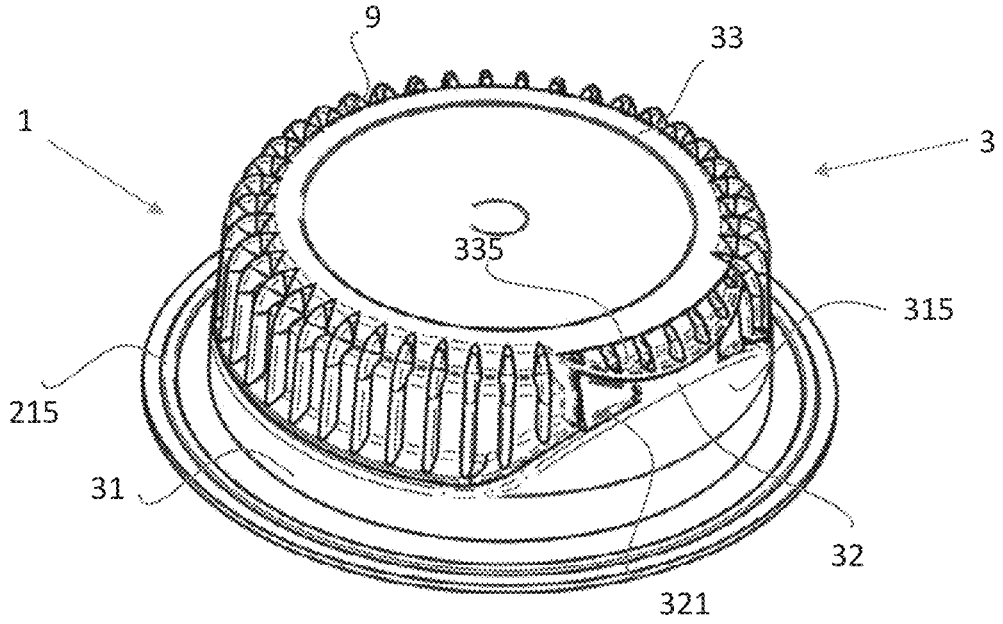
Figure 10B:
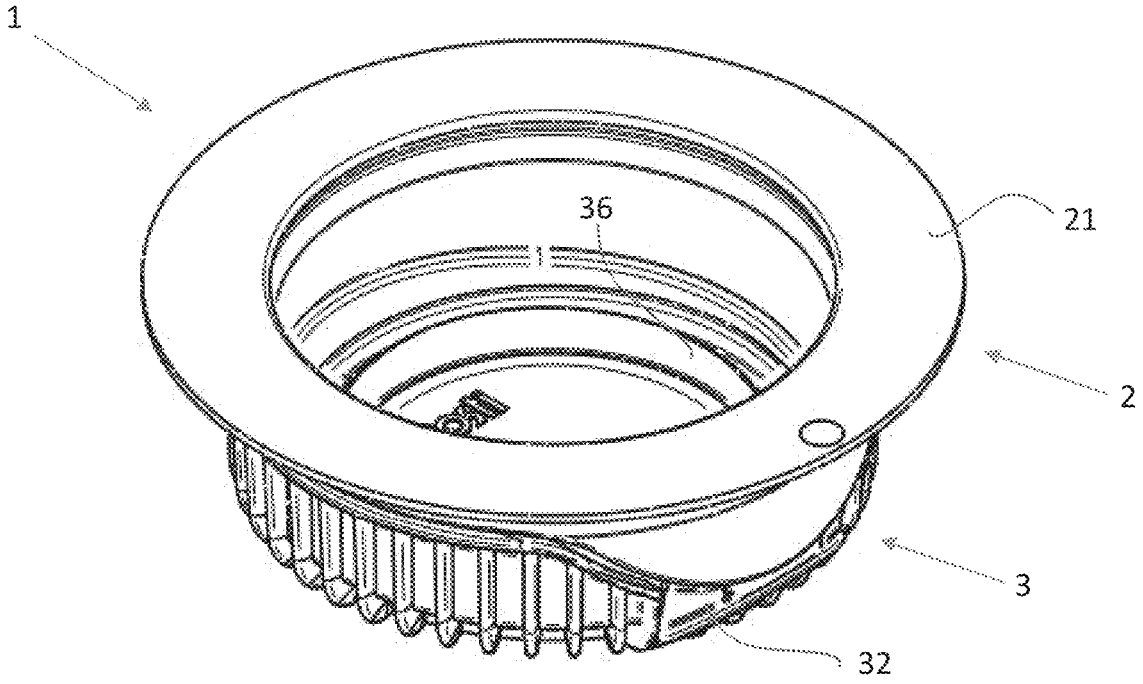
Figure 12A:
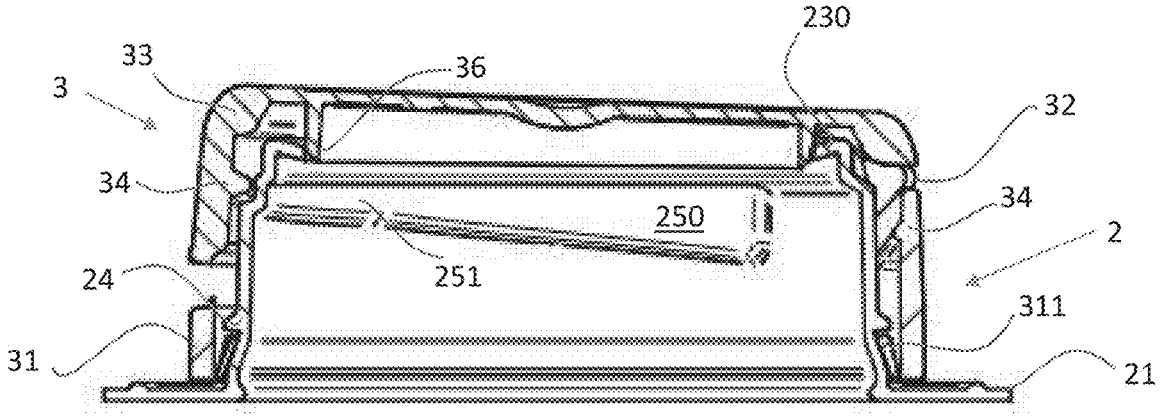
Figure 12B:
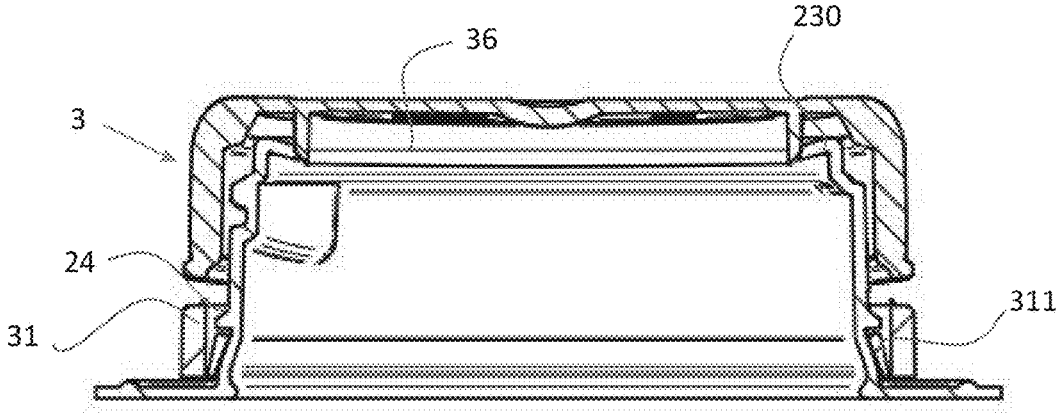
Figure 13A:
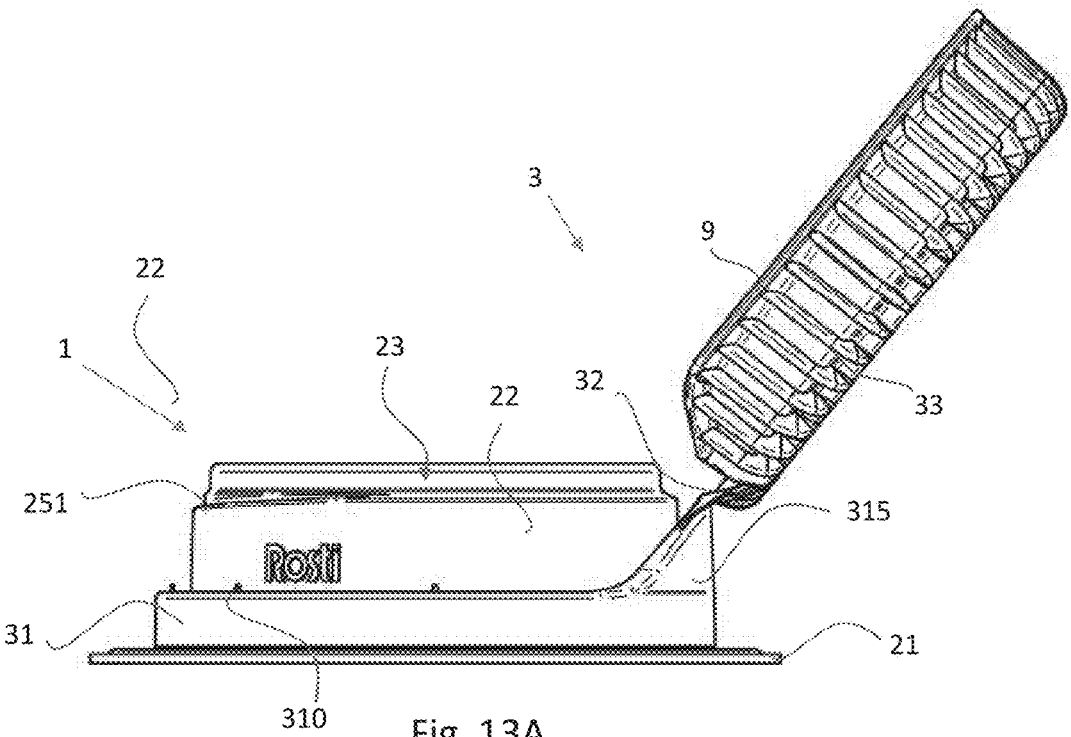
Figure 13B:
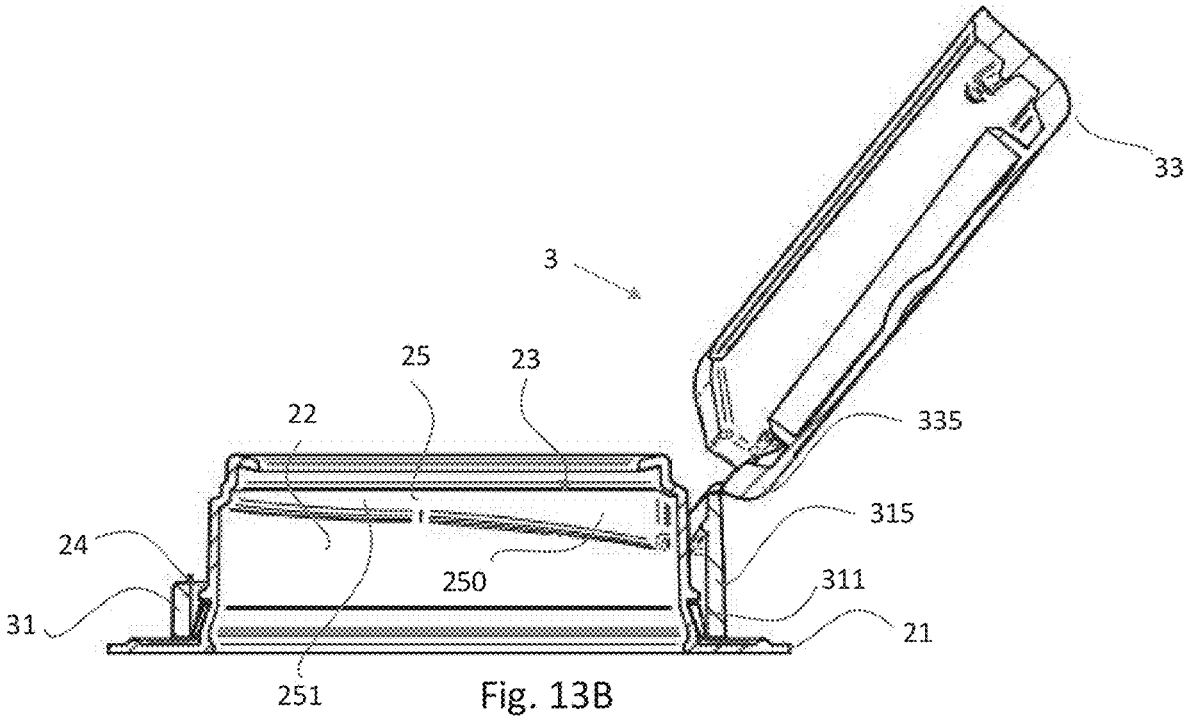
Figure 13C:
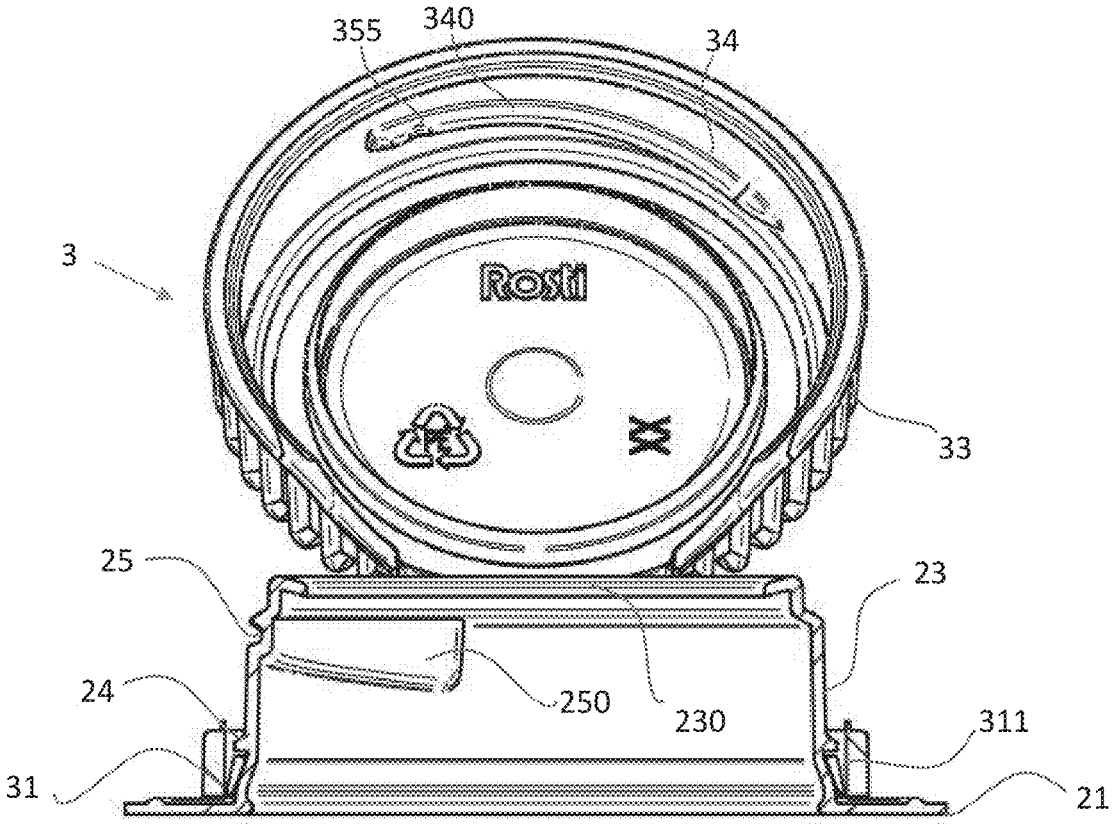
Figure 14:
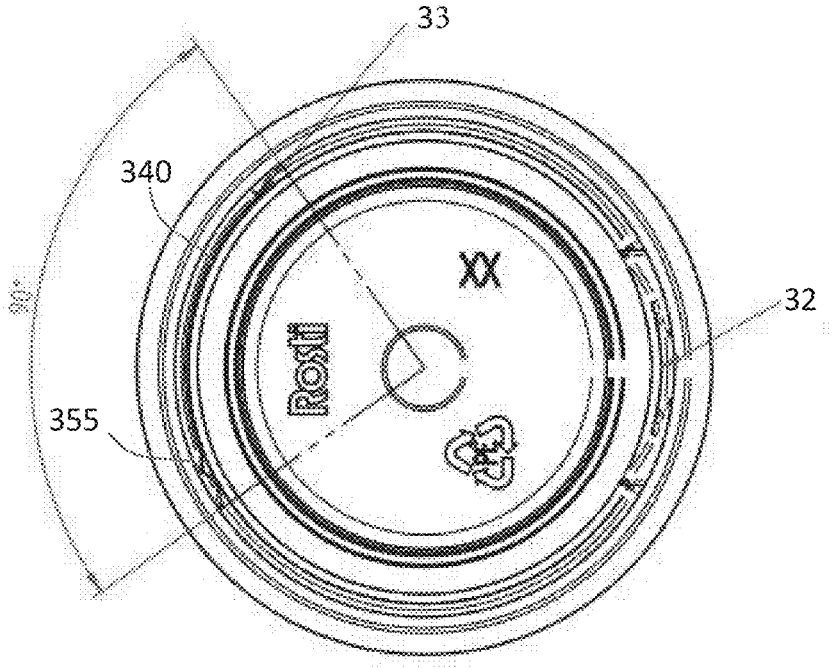
Figure 15A:
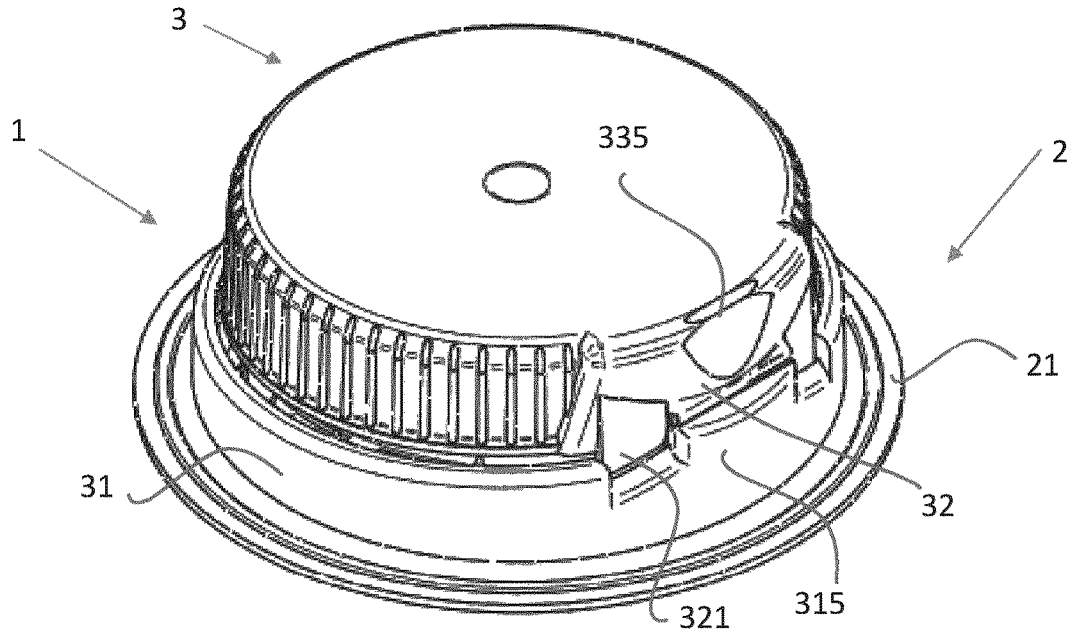
Figure 15B:
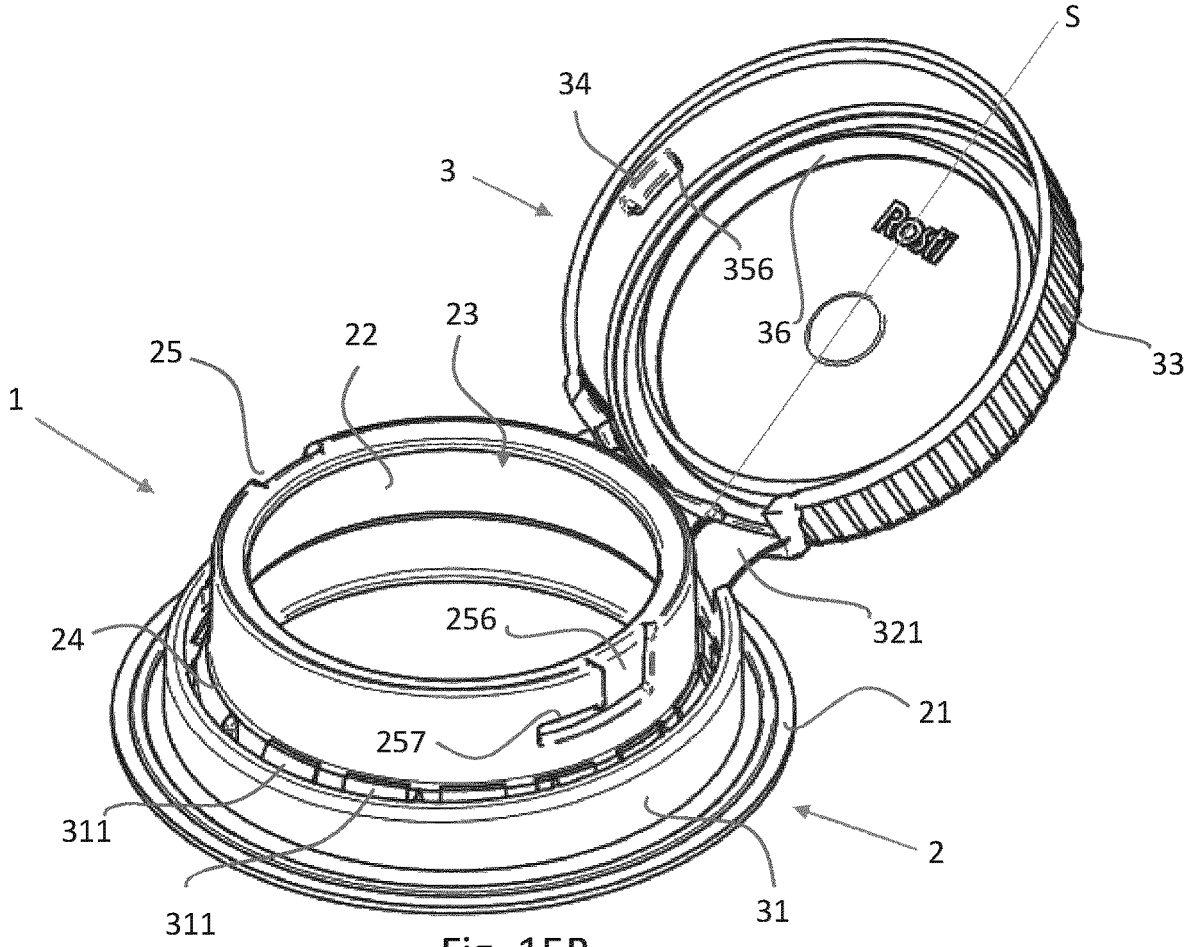
Figure 16:
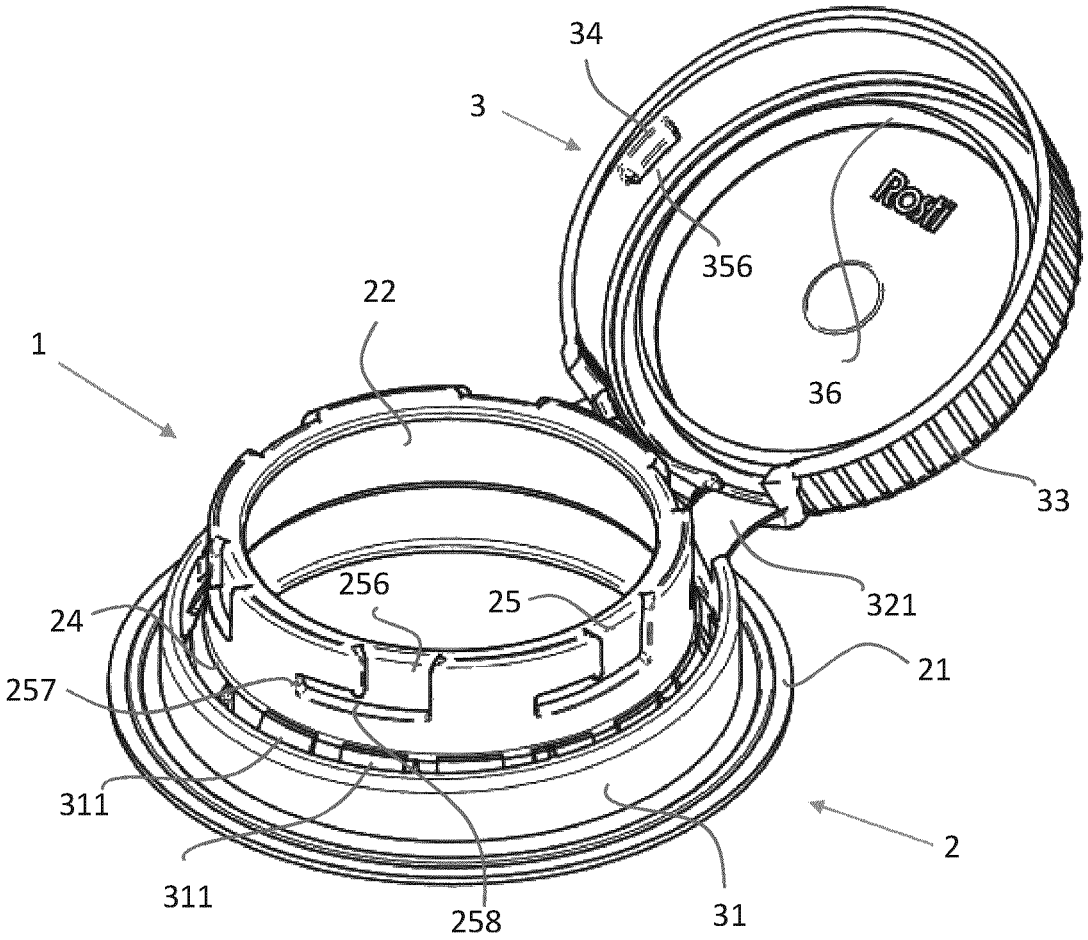

Hereinafter the different aspects of the invention will be explained in detail by reference to several embodiments. Thus, now showing:

FIG. 1 a first embodiment of a multi-component closure according to the principle proposed in a closed state;

FIG. 2 the multi-component closure on a cardboard packaging in an opened and unfolded state to illustrate some aspects;

FIG. 3A to 3D different side and cross-sectional views of the multi-component closure in a closed state according to the preceding exemplary embodiment;

FIG. 4A to 4C different side and cross-sectional views of elements of the multi-component closure in an open state;

FIG. 5A to 5C different side and cross-sectional views of the multi-component closure in an unfolded state to illustrate some aspects according to the first exemplary embodiment;

FIG. 6 a view into the closure cap to illustrate some aspects according to the first exemplary embodiment;

FIG. 7 a second embodiment of a multi-component closure according to the principle proposed in a closed state;

FIG. 8 the multi-component closure of the second embodiment in an open and unfolded state to illustrate some aspects;

FIG. 9 a side view of the screw cap of the second embodiment;

FIGS. 10A and 10B a perspective view from above and below also the multi-component closure of the second embodiment;

FIGS. 11A to 11D different side and cross-sectional views of the multicomponent closure according to the second Embodiment in a closed state;

FIGS. 12A and 12B 2 cross-sectional views of the multi-component closure according to the second embodiment in an open state;

FIGS. 13A and 13C 3 cross-sectional views of the multi-component closure according to the second embodiment in an open state;

FIG. 14 a view into the closure cap of the second embodiment to illustrate some aspects FIGS. 15A and 15B the multi-component closure in a third embodiment in a closed as well open and unfolded state to illustrate some aspects;

FIG. 16 a further embodiment of the multi-component screw cap.

It is self-evident that the individual aspects of the embodiments illustrated in the figures above can be combined readily with each other, without this contradicts the principle according to the invention. The individual figures and aspects are not necessarily in right size, however, the relative importance between individual elements should essentially be correct. In particular terms as "over", "above" "under", "below" "larger", "smaller" and similar with regard to the elements in the figures are illustrated correctly. In this respect it is possible, based on the figures to extract such relations between the elements.

DETAILED DESCRIPTION

FIGS. 1 and 2 show a multi-component closure in closed and unfolded state for a carton- or cardboard packaging according to the proposed principle. The multi-component closure is produced during the production process by means of an injection molding process from 2 parts, a bottom part 2 and a screw cap 3. Subsequently the bottom part, for example, can be welded or glued onto the cardboard packaging over the opening of the cardboard packaging. Then the screw cap in a final step is placed on the cardboard packaging filled with liquid. Alternatively, bottom part and screw cap can be put on each other also in advance and subsequently the multi-component closure welded with the packaging over the opening of the cardboard packaging.

The multi-component closure comprises a bottom part with a laminar support 1. In the present exemplary embodiment the support 1 is designed circular, however, it can also have another form. On the laminar support 1 a neck 22 (shown in FIG. 2) is arranged in one piece.

The multi-component closure further comprises also a screw cap 3 with a closure cap 33 as well a retaining ring 31. The retaining ring 31 and the closure cap 33 are connected with each other via a hinge 32. Also, the screw cap 3 with its elements is designed in one piece and is produced, for example, as well as the bottom part by means of injection molding process. In the perspective view illustrated herein the retaining ring 31 comprises further a hinge flap 315, at which the one joint of the closure 32 is moulded-on directly. The joint in turn is connected with a second hinge flap 335, which forms a part of the closure cap 33.

In addition, at the closure cap a fluting 9 is attached, which on one hand provides a user an optical feedback and on the other hand serves for better gripping during a rotational movement to open resp. close the closure cap 33. The optical and haptic feedback, for example, is ensured by the slightly different fluting (as shown), which indicates to a user a suited grip position to open and close the closure cap. In addition, in some embodiments material can be economized by a different fluting.

In the open state of FIG. 2 further elements of the multi-component closure become visible. Thus, the neck 22 arranged on the laminar support 1 comprises an opening 23 with an inwardly folded flexible flap 230. On the outside of the neck 22 in addition in this embodiment a male thread is arranged with several male thread segments 250 as first locking element 25. To individual aspects of this locking elements is referred in the following figures.

The screw cap 3 in turn is arranged with its bottom part between the plan of the Support 21 and a restring 24. Restring 24 is part of the neck 22. Thereby the retaining ring 31 and restring 24 are designed such, that the retaining ring is kept freely rotatable between restring and support, however, not movable beyond the restring. In this respect the retaining ring 31 is thus limited in a movement in z-direction, i. e. towards the neck opening 23. The retaining ring is smooth, thus, does not comprise in contrary to the closure cap no fluting. Thereby on one hand material is economized, on the other hand an optical separation between closure cap and locking is indicated. Closure cap 33 comprises on its inside a second locking element 34 in form of two thread segments 340. At one end of each female thread segment a rast 355 is arranged, whose functionality is explained in the following. In addition, the closure cap 33 comprises a sealing ring 36.

In embodiment of FIG. 2 illustrated herein two female thread segments 340 are provided, which are arranged facing each other on the inside of the closure cap around an axis of symmetry. The axis of symmetry is an axis extending through the middle of the hinge 32 and the midpoint of the closure cap 33. The second Segments 340 engage during a rotation of the screw cap 3 around the neck 22 resp. the neck opening 23 into the respective outer segments 250. such that the sealing ring 36 and the neck opening 23 causes a liquid-tight connection.

The multi-component closure in the example of the FIG. 2 is arranged on the upper side of a cardboard box or a cardboard packaging and welded or glued to the board via the support 21. Different color elements can be mounted on the cardboard packaging, which besides esthetic aspects also can indicate to the user potentially the direction of rotation to open and/or close. The size of the carton opening and thus the size of the closure can be adapted to the size of the cardboard packaging and is freely selectable. The same holds for the fold of the cardboard packaging, its form and embodiment. In some embodiments a cardboard flap is provided (see FIG. 2), by means of which pression can be taken from the closure, when several cardboard packagings are stacked on top of one another. Furthermore, the flap indicates the pour out direction. In this respect the closure is then with its bottom part also attached to the carton in such a way, that the closure cap can completely unfold in direction towards the cardboard packaging flap.

Figure 3A:
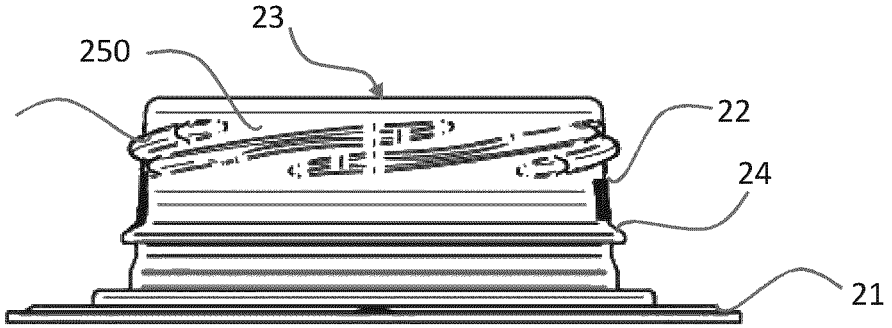

FIGS. 3A to 3D show a side view of the multi-component closure resp. of the parts thereof as well cross-section views available on this. FIG. 3A shows the bottom part with the laminar support 21 and the neck 22 attached to this. The neck 22 has a lower section, whose end is determined by the restring 24. As indicated in this view, the lower section is implemented with a diameter slightly tapering in direction towards the restring 24. Thereby the restring has on its side facing the plane of support 21 a relatively large retention region, as it is for example shown in FIG. 3C in a cross-section. In this retention region resp. on the underside of the restring 24 the retaining element of the retaining ring 31 thus can engage. In direction towards the neck opening 23 the restring 24 is implemented with inclined surface.

Neck 22 further comprises several other male threads 250. which are arranged circumferentially around the neck. The male threads 250 comprise each a constant pitch, which for example can depend on the number of the male threads, the thickness of the individual male threads as well as the distance of the male thread from each other. In the present exemplary embodiment, for example, the pitch can be indicated by the parameter P=8. The individual outer segments 250 comprise a length L, which has a length, which can be expressed also in a relation to the circumference of the neck. Thereby the position of the male thread is implemented such, that these overlap as illustrated at least partly. Thereby during a rotational movement of the closure cap the female thread is guided through the different male threads, such that the closure cap resp. the sealing ring interacts with the neck opening and closes this in a liquid-tight manner.

Figure 3B:
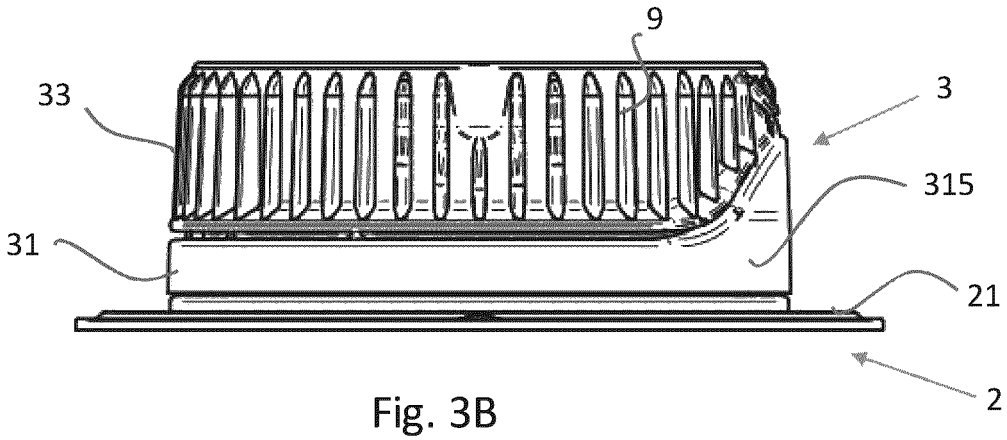

FIG. 3B shows the side view of the multi-component closure in its closed form. On the neck 22 the screw cap 3 is placed and the same time closed. For this purpose, the retaining ring comprises a plurality of connecting webs not shown resp. visible here, with which the closure cap 33 is kept at the retaining ring 31 prior to first opening. The retaining ring shows in addition on its right side a hinge flap 315, which in direct comparison with the FIG. 3A arises above the restring and constitutes a part of the hinges. Closure cap comprises also the fluting 9, which consists of several perpendicular webs circulating around the closure cap 33, whose density, however, is variable. Thereby, for example, a grip position can be optically indicated to the user.

Figure 3C:
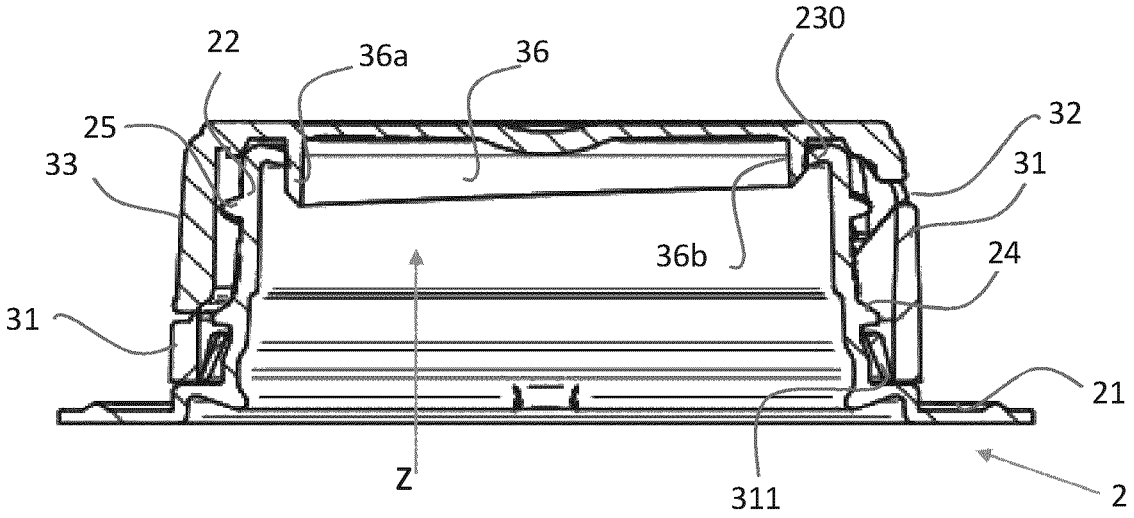
Figure 3D:
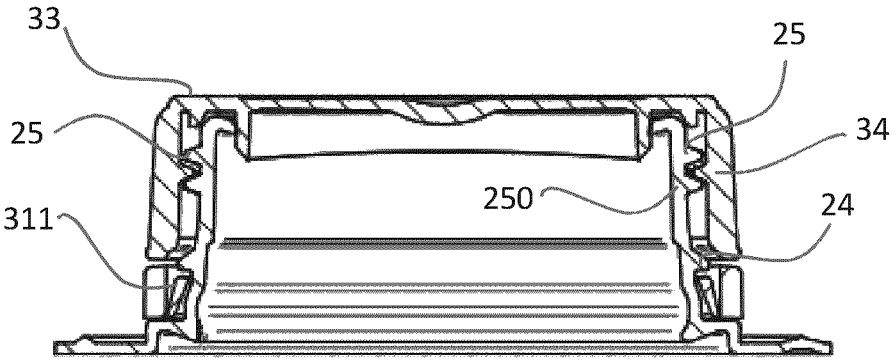

FIGS. 3C and 3D show cross-sectional views in two different directions, i.e. along a plane through the hinge 32 as well as along a plane parallel to the hinge. As to recognize in FIG. 3C, the retaining ring 31 comprises on both sides several retaining elements 311, which are designed, to collaborate with the restring and thus to keep the retaining ring essentially inseparable rotatable around the neck. Thereto they are with their one end, i.e. the end facing the support pivotally attached to the retaining ring 31. The other end of the retaining elements 311 faces the side of the restring 24 facing the laminar support. Thereby the underside of the restring 24 acts, in a direction of motion of the retaining ring 31 in z-direction on the rear side elements 311, such that a motion is prevented effectively. For a production in turn the retaining elements on the retaining ring are first folded over and then the retaining ring together with the closure cap 33 attached thereto plugged over the neck opening. Thereby the retaining elements move over the restring 24 in direction towards the supporting surface 21 until they engage in the interspace between the restring 24 and the supporting surface 21.

Besides the restring 24 the neck 22 comprises also the first locking element 25 shown in cross-sectional view, which is designed with a male thread with several segments 250. Clearly visible in FIG. 3D, the second locking element 34 of the closure cap 33 engages between two of the male thread segments 250. such that the closure cap closes the neck opening effectively.

Again, referring to FIG. 3C the screw cap comprises also the hinge 32, which is shown here on the right side. The hinge 32, in particular the flexible joint is arranged above the locking elements 25 resp. 24. Above means in this respect, that the distance to the supporting surface is larger than the distance of the respective locking elements to the supporting surface. Due to the position of the flexible joint the closure cap can be after an opening folded up in a simple manner and also shut again, without the sealing ring 36 cants in the neck opening 23.

Moreover, the sealing ring 36 comprises two special features. On the one hand its height, i.e. the distance from the inner side of the closure cap to the lowest point of the respective sealing ring depending on the distance to the flexible joint of the hinge 32, as it is recognizable, for example, in the cross section of the FIG. 3C. The region 36*b* of the sealing ring near the hinge 32 comprises a slightly lower height than the region 36*a* of the sealing ring. Thus, as illustrated the height increases with increasing distance from the hinge. An angle spanned in this view between the lower edge of the region 36*a* and the lower edge of the region 36*b* comprises with respect to a plane parallel to the supporting surface 21 ca. 2 to 3°, in the concrete exemplary embodiment ca. 2,7°. This angle can also be larger, i.e. the "height difference" in this sectional view can be larger. However, it should be at least 1.5°, to prevent a canting. As well it should be mentioned, that a large height difference potentially does not mean an improvement with respect to the opening and closing, however, additional material has to be spent. A range from 1.5° to ca. 4° has proven to be a good compromise for the opening provided. In this context it should be mentioned, that the angle also depends on the size of the opening as well as on the distance between hinge and opening. The smaller the distance, the larger the angle should be. The same holds for the height of the hinge with respect to the upper edge of the neck opening. If the hinge is on the same height or slightly above, the angle can be smaller or even 0°. The further underneath the hinge lies with respect to the upper edge of the neck opening, the larger the angle had to be.

Due to the different height of the sealing ring in dependence of the distance to the hinge the risk of a canting is further reduced during a folding open and shutting of the closure cap. In particular it is ensured, that the lower region of the sealing ring engages in each case simultaneously in the neck opening.

A second special feature of the sealing ring consists in the form of the lower edge, which is slanted as illustrated in FIGS. 3C and 3D. In other words, an outer side surface of the sealing ring slightly smaller than the inner side surface, such that a chamfer outward arises. Thereby the sealing ring during folding in stripes over the neck opening 23. To close the screw cap in a liquid-tight manner in addition the diameter of the sealing ring 36 is designed slightly larger than the corresponding diameter of the neck opening resp. the flap 230. Thereby as illustrated in the FIGS. 3C and 3D the flap 230 of the neck opening during closing the closure cap pressed slightly downwards and lies flush on the outer side of the sealing ring 36. Thereby a sufficient seal against liquids is effected.

The FIGS. 4A to 4C show the multi-component closure in an open resp. screwed open but not folded open state. FIG. 4A is the side view of the multi-component closure. By means of a rotational movement the first locking element 25 guides the second locking element in direction towards the neck opening, whereby the connection webs 310 between the retaining ring 31 and the closure cap 33 are disrupted. The screw cap 3 rotates by the rotational movement with its retaining ring 31 around the neck. Thereby also a slight rotation of the closure cap around the flexible joint of the hinge 32 is effected.

FIG. 4B shows a cross section of the multi-component closure parallel to a plane through the flexible joint. It is clearly recognizable, that by the rotational movement of the screw cap the inner ring 36 in the closure cap 33 bears now with its outer ends against the inwards directed flap of the neck opening 23, due to the different height of the sealing ring 36 in dependence of the distance to the flexible joint of the hinge 32 the sealing ring 36 touches still running around the neck opening and therefore closes this still sufficiently. In this position it is also recognizable, that with an open closure and a later folding the sealing ring essentially engages at all positions in the neck opening simultaneously.

FIG. 4C shows the embodiment in a cross section in a plane parallel to the flexible joint. The sealing ring 36 is with its ends essentially at the height of the neck opening. The same time the female thread segment 340 now is lying freely on both sides, such that the closure cap around the flexible joint of the hinge can be rotated.

This unfolded illustration is shown in FIGS. 5A to 5C, where the closure cap is opened in ca. 120° to a plane parallel to the supporting surface 21. By means of the hinge 32 the closure cap 33 as well is kept in this position, such that with a corresponding movement of the cardboard box a liquid can pass through the neck opening, without the closure cap folds back by gravitational force. Moreover, in FIG. 5A is illustrated a possible position of the closure on a cardboard packaging with gabled roofed shape. Other cardboard packagings are possible. The gabled roof of the cardboard packaging comprises a ridge 201, on which the beveled surfaces 200 impinge and are glued with each other there. On one of the surfaces 200 an opening is arranged, on which the multi-component closure is mounted.

FIG. 5B shows the cross-sectional view parallel to a plane through the flexible joint of the hinge 32. In FIG. 5C the corresponding cross section through a plane parallel to the flexible joint of the hinges is shown. The closure cap 33 thus is situated behind the cross-sectional plane. The sealing ring 36 is clearly recognizable as well as both the female thread segments 340. These are arranged opposite each other.

The male thread segments illustrated in FIGS. 5A and 3A comprise a pitch, which is slightly larger than the corresponding pitch of the female thread segments illustrated in FIGS. 5C, 5B and 1B. By the different pitch it is ensured, that in a closing of the closure cap after completion of the rotational movement both the segments engage in such a way, that they are under tension and therefore keep the closure cap in the closed position. For this purpose, the respective segments, i.e. male and female thread segments can be designed with different length. Under the term different length thereby different circular segments are understood, which form each a fraction of a complete circle, i.e. over 360°. In FIG. 6, for example, a view into the closure cap is illustrated, where the hinge 32 is indicated and the thread segments 340 are illustrated. These comprise in this embodiment a different extension. A thread segment corresponds essentially to a circular segment of 45°, the second female thread segment a circular segment of 68°. Reason for the thread segments of different length is the improved closure by means of slightly asymmetric distribution of force, which enables in a closed state an improved canting and thus a higher rigidity, and resistance against an unintended rotational movement, respectively.

FIG. 7 shows a second embodiment of a multi-component closure according to the principle proposed in a closed state. Same elements or elements with the same effect show the same reference signs.

The hinge 32 comprises in the illustrated embodiment a first hinge flap 315, which form a part of the retaining ring 31, as well as a second flap 335, which is a part of the closure cap. The flexible joint of the hinge 32 is made of a flexible material and connects the retaining ring 31 and the closure cap 33 with each other in one piece. The second hinge flap 335 thereby comprises a downward formed parabolic or differently bent form. Correspondingly also the embodiment of the first hinge flap 315 is formed, which as well increases along a curved track to a maximum and afterwards decreases again. Between these two curved hinges flaps the flexible joint is arranged as material. Due to the curvature is the flexible Joint in the outer regions, i. e. distanced from a midpoint of the hinges with a folding up of the closure 33 subjected to a stronger pull. This pull creates a counterforce, which has to be overcome during a rotational movement of the closure cap around the flexible joint. The force increases with a rotational movement up to a maximum, where the pull on the material of the flexible joint of the hinge 32 is maximum. With a further rotational movement this pull becomes smaller again. Thereby the material of the flexible joint acts as a snap element, where a maximum angle will emerge, in the exceeding of which the snap element by its pull brings the closure cap in the unfolded form.

FIG. 8 shows the second exemplary embodiment of the multi-component closure in its unfolded form. The closure 1 comprises also here a bottom part 2 as well as a screw cap 3, which with its retaining ring was slipped over a neck 22 of the bottom parts 2, such that the retaining ring 31 for a movement regarding the z-direction, i. e. neck opening is limited. In contrary to the preceding example the neck comprises a locking segment, which is designed from a single thread segment 2 with different pitches. Thereby the first section of the thread segment comprises a first pitch, at which seamlessly a second section with a second slightly larger pitch connects. The different pitches effect a gripping of the female thread segment 340 in a rotation of the closure cap to close the closure. In the female thread segment in addition a rast mark 355 is arranged, which engages in a corresponding latch cam in the male thread segment (not shown here). Closure cap 33 comprises a sealing ring 36 in similar embodiment as in the preceding example, as well as a hinge 32 with a flexible joint. The hinge is in the unfolded state slightly relaxed, a rotational movement back again, would lead to a force, which counteracts the rotational movement. Thereby the closure cap is kept in the unfolded state. An opening angle in the unfolded state is more than 90° and, for example, can lie in the range from 115° to 150°, in particular around ca. 120°.

FIG. 9 shows the embodiment in the closed state in side view. The retaining ring 31 is via several connecting webs connected with closure cap 33. As in the preceding example the retaining ring comprises a hinge flap, at which the flexible joint of the hinge 32 is attached. FIGS. 10A and 10B describe the multi-component closure in perspective view from above resp. from below. The hinge 32 comprises as in the preceding example first hinge element 315, which is part of the retaining ring 31, as well as a second hinge element 335, which forms a part of the closure cap 33. Both hinge elements are designed arc-shaped, where they have in the center of the hinges their smallest distance from each other. There also the flexible joint is arranged. In this embodiment the hinge 32 further comprises also two tensioning elements 321, which are arranged on both sides of the flexible joint and fix the first part of the hinge on the second hinge part under tension. With a rotation of the closure cap 33 around the flexible joint of the Turniers 32 both tensioning elements 321 are placed under angle dependent tension, where in the exceeding of a maximum angles both the tensioning elements 321 pull the opened closure cap in an opened end position. Thereby the closure cap in exceeding the rotation angle by a defined amount snaps on and the tensioning elements 321 prevent a folding back at the closure cap also when the closure itself is rotated, e.g. when dumping.

FIG. 10B shows the multi-component closure according to the invention from the underside. Supporting surface 21 forms a laminar ring, which can be glued to the cardboard material resp. by means of a welding seam 215 illustrated in FIG. 10A welded to the cardboard material. Also recognizable is the sealing ring 36 of the closure cap 33, which engages in the neck opening and closes this in a liquid-tight manner. The embodiment shown in FIGS. 10A and 10B is produced, by producing both the bottom part 2 and the screw cap 3 each in one piece with their elements. Subsequently the screw cap in a closed state is guided over the neck, such that the retaining ring 31 engages in the restring of the neck 22. Subsequently, the element can be put on a cardboard box and be welded with this.

Figure 11A:
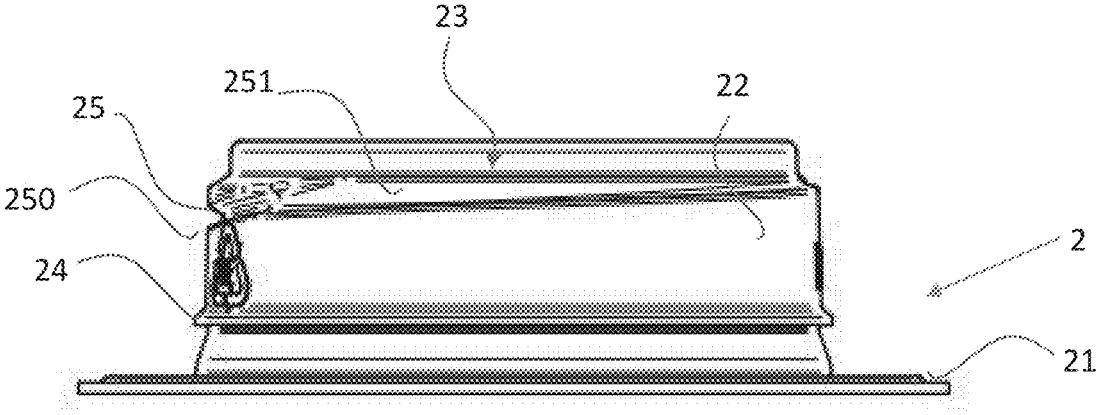

FIGS. 11A to 11D show the multi-component closure in different views and cross-sectional views. FIG. 11A shows the bottom part in a side view with its supporting surface 21, its neck 22 formed thereon in one-piece as well as neck opening 23. Around the neck runs a first locking element, which comprises a male thread segment 250. at which a connection thread segment 251 directly connects. The male thread segment 250 extends about half the circumference of the neck and comprises a first pitch. The connection male thread element 251 connected to this has a significantly smaller pitch and serves essentially for gripping of an inner segment of the closure cap during unscrewing of the closure of the neck. Thereby during the unscrewing of the closure, a rotational movement between 70 and 420° necessary, to effectively connect the closure cap with the neck and thus to achieve liquid-tightness. Neck 22 further comprises the restring 24, over which the retaining ring 31 of the screw cap is slided.

Figure 11B:
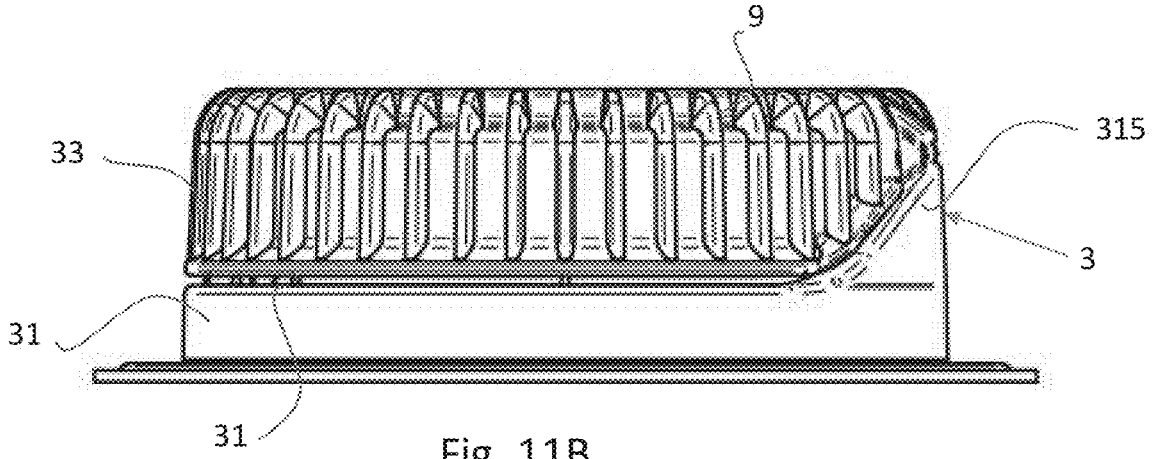
Figure 11C:
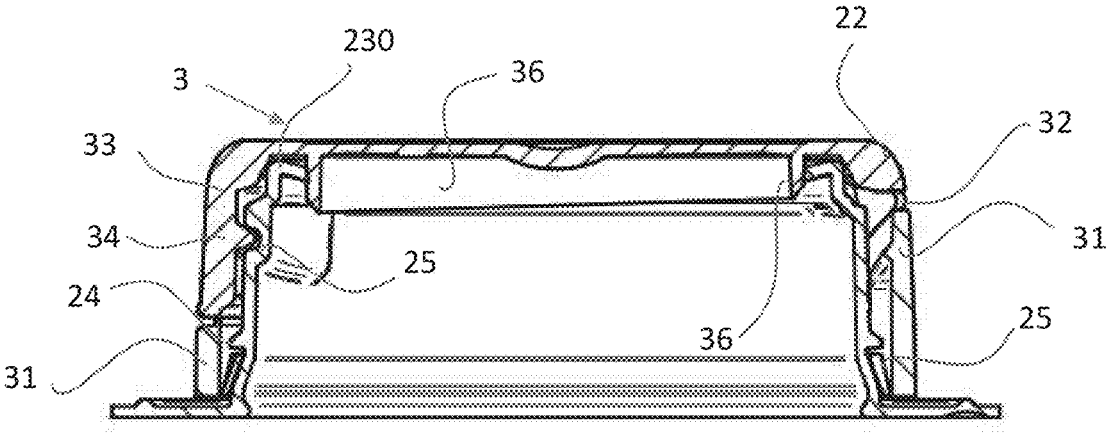
Figure 11D:
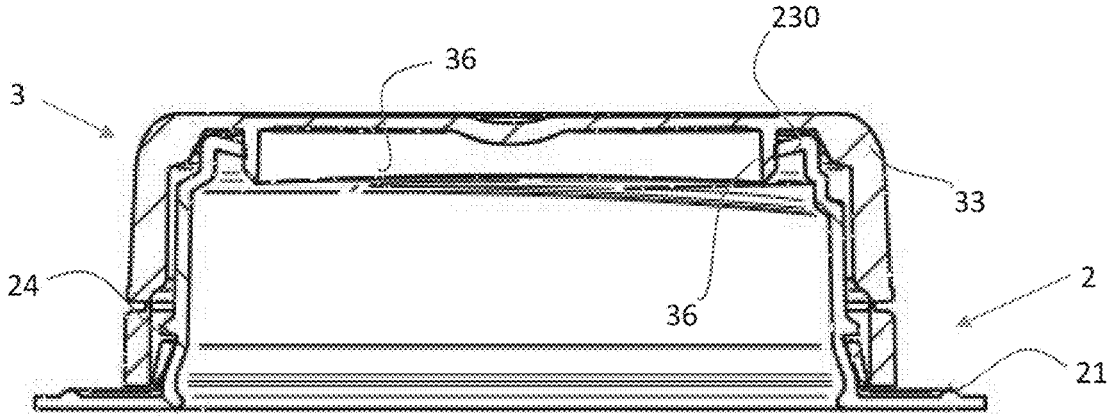

FIG. 11B shows the side view of the screw cap in its closed form of the bottom part. FIGS. 11C and 11D show each cross-sectional views parallel to a plane through the hinge resp. in a plane parallel to the hinge. As in the preceding example the sealing ring 36 is designed asymmetrically, i. e. its side opposite to the hinge comprises a greater height than the part of the sealing ring, which is facing the hinge 32. Thereby an angle emerges from about 2.5° to 3.5° with respect to a plane parallel to the closure cap.

In FIG. 11C as well the first locking element 25 can be recognized, that is designed as male thread and in that the single female thread of the second locking element 34 engages. As recognizable in this illustration, both the first locking element and the second locking element are arranged opposite to the hinge, such that a seal and a closed state of the screw cap is ensured in this position. This is achieved with different pitches of the first and second Locking elements, and a slightly larger radius of the sealing ring with respect to the flap 230. Thereby the latter is kept by the sealing ring under a slight tension, bent downwards and thus closed in a liquid-tight manner.

FIGS. 12A and 12B show the cross-sectional views of the closure in an open, but not yet unfolded state. The sectional views correspond to those of the FIGS. 11C and 11D. The opening of the closure is effected by a rotation of the closure by ca. 90° resp. slightly more than 90°. By means of the rotation the female thread of the closure cap follows the male thread segments 250 until connection thread segment 251 and is released there. By means of the pitch of the male thread segments 250 furthermore also a tearing of the different connecting webs between the closure cap 33 and the retaining ring 31 during the rotational movement is effected. Thereby the individual connecting webs rupture mainly first in a region far from the hinge 32 and only subsequently the connection webs, which are located closer to the hinge 32. In this respect by the rotational an opening of the closure cap is effected in a coordinated and predictable manner.

By means of the rotational movement the sealing ring is moved in addition along the inner plate of the neck opening upwards. By the different height of the sealing ring 36 illustrated in FIG. 12A it is further ensured, that also during the rotational movement the sealing ring still remains on the inner plate 230 of the neck opening. Thereby it is ensured after a first-time opening, that also during a subsequent closing a canting of the sealing ring at the flange 230 is prevented. In particular it is ensured, that the sealing ring before a new closing finishes correctly and accurately positioned on the flap and of the neck opening securely and in a liquid-tight manner, as illustrated in the FIG. 12A, is the height of the ring in this open, but not yet unfolded state essentially parallel to the supporting surface. In other words, the difference in height between the region facing away from the hinge and the region of the sealing ring facing the hinge essentially corresponds to the pitch of the connection male thread segment. FIG. 12B shows the cross section along a plane parallel to the flexible joint of the Turniers.

Along this plane the height of the sealing ring 36 is to both ends the same. In FIGS. 13A and 13B the multi-component closure is illustrated in its completely unfolded form. The hinge 32 in FIG. 13A is designed such, that the tensioning elements keep the closure cap 33 in the illustrated open form, i. e. an angle of more than 90°, as for example here essentially 120°. Thereby it is prevented, that the closure cap 33 during an outpouring of a liquid, i. e. a rotational movement of the complete multi-component closure falls back again and thus liquid is splashed unintendedly. Furthermore, the connection male thread segment 251 is illustrated in this illustration. The pitch thereof is significantly smaller than the here not shown male thread segment 250 and serves for gripping of the female thread segment, when the closure cap is screwed again on the neck opening. FIG. 13B shows the cross-sectional view along a plane, which leads through the hinge. As explained already above, the connection male thread segment connects seamlessly to the male thread segment 250. whose pitch is larger than the connection male thread element. FIG. 13C shows the view in cross section along a plane parallel to the flexible joint. The female thread segment 340 comprises at its outer end a notch 355, which engages in a corresponding latch cam of the connection male thread segment 250 at the end of a rotational movement of the closure cap on the neck opening. Thereby on one hand a complete closing of the neck opening by the closure cap is indicated to the user in a haptic manner, on the other hand the notch and the latch cam serve for an additional locking of the closure cap on the neck opening. Thereby an unintended opening of the closure cap is prevented also after a first-time opening of the closure cap.

As illustrated in FIG. 14 the inner segment is arranged opposite to the hinge 32. In this embodiment the length of the female thread segment is chosen essentially such, that it corresponds to a quarter of a circumference of the inner side of the closure cap 33. It is mounted opposite to the hinge 32. Thereby in a complete closure of the closure cap the inner segment engages on the neck opening in the outer segment 250 such, that these two lie directly opposite to the hinge. Thereby results a high frictional connection on the closure cap, such that the sealing ring interacts in a liquid-tight manner with the neck open-in-resp. the flap 230 of the neck opening.

FIG. 15A shows an alternative embodiment of the hinge 32. In this embodiment the flexible Element in turn is attached to a first hinge flap 315, which is part of the retaining ring 31. The flexible joint is connected on the other side with the second hinge element 335. To open and close the closure cap two pull elements 321 are arranged on both sides of the first hinge element 315. These pull elements 321 are designed from a flexible and tensible material. Their arrangement is such, that their attachment point facing the supporting surface 21 lies below the flexible joint of the hinges. Thereto in the retaining ring 31 two recesses are provided, which are arranged on both sides to the first hinge element 315. The flexible material of the pull elements 321 is mounted there. Preferably in one piece the pull elements are connected with their other end at the upper second hinge element 335.

FIG. 15B shows the perspective embodiment in an open state of the screw cap. During the opening process on both the pull elements 321 a pull is exerted, such that these first counteract the rotation of the closure cap and the flexible joint of the hinge. Upon exceeding of a maximum angle, which corresponds to a maximum pull, both the pull elements 321 snap over and generate now a pull, which pulls the closure cap in the position illustrated in the FIG. 15B. By the pull of the elements 321 in the now unfolded state is prevented, that the closure cap 33 in outpouring of a liquid falls back again and thus liquid is splashed unintendedly.

In this embodiment in addition the locking elements 25 and 34 of a further embodiment are designed as so-called bayonet catch. This bayonet lock comprises on the neck each 2 longitudinal slots 256 arranged opposite, at each of which a transversal slot 257 connects. The transversal slot 257 comprises a width, which essentially corresponds to the locking element 156 on the inner side of the closure cap 33. The length of the locking element 356 in turn is chosen such, that it engages in the longitudinal slot 256 of the screw cap.

Furthermore, in this embodiment the retaining elements 311 are visible, which are attached on the retaining ring and engage from below in the restring 24 and thus prevent a removal of the screw cap.

FIG. 16 shows a further embodiment of the multi-component screw cap. In this are several, i. e. six longitudinal slots 256 arranged symmetrically around the neck and each connected with a transversal slot 257. In contrast the closure cap 33 further comprises only 2 thread segments 356 arranged opposite to each other. This embodiment makes it possible, to guide in a closing of the closure cap with a small rotational movement the female thread 356 in one of the bayonet caches and to close there. For this purpose, each transversal slot is a in the preceding example designed with a small latch cam 258 on its end facing the longitudinal slot. Die latch cam prevents a turn back of the closure cap in the closed state and allows like this a catching of the female thread segment 356 in the transversal slot 258.

The invention claimed is:

1. A multi-component closure, in particular for a liquid containing cardboard packaging, comprising:

a bottom part with a laminar support and a neck arranged thereto in one piece, where the neck comprises:

a neck opening;

a restring enclosing the neck; and at least one first locking element, which is arranged between the neck opening and the restring;

a screw cap with a retaining ring and with a closure cap attached on the retaining ring via a hinge, where the retaining ring is arranged at least partly between the support and the restring around the neck and is kept rotatable by the restring; and wherein the closure cap comprises at least one second locking element, which in a closed state acts together with the at least one first locking element to close the neck opening with the closure cap in a liquid-tight manner and that in the closed state a turn of the screw cap around the neck in a first direction causes an opening of the screw cap; and wherein the hinge comprises a flexible joint arranged between the retaining ring and the closure cap, wherein an axis of rotation of the flexible joint is closer to a plane spanned by the neck opening than the first locking element and the second locking element and/or wherein the flexible joint is arranged above the first locking element and the second locking element with respect to the laminar support of the bottom part.

2. The multi-component closure according to claim 1, wherein the retaining ring is connected to the closure cap via a multitude of predetermined breaking points forming connecting webs;

and/or wherein the restring with a side facing the laminar support extends essentially parallel to the support and a side facing away from the laminar support extends obliquely to the support.

3. The multi-component closure according to claim 1, wherein the retaining ring comprises a multitude of retaining elements, which are designed to keep in conjunction with the restring the retaining ring essentially inextricably rotatable around the neck;

and optionally wherein the retaining elements are attached pivotally at first end to the retaining ring, and having a second end facing a side of the restring, which faces the laminar support; wherein optionally a swivel axis of the retaining elements faces the laminar support.

4. The multi-component closure according to claim 1, wherein the at least one first locking element comprises at least a male thread segment with a first pitch and the at least one second locking element comprises at least a female thread segment with a second pitch, optionally on an inside surface of the closure cap;

optionally wherein the at least one first locking element comprises four to six male thread segments and the at least one second locking element comprises two female thread segments, where these are arranged with respect to a respective axis of symmetry through a central point of the closure cap substantially perpendicular to the hinge and/or the two female thread segments facing each other;

and/or wherein a length of the female thread segment essentially corresponds to 0.1 to 0.3 times, or to 0.1 to 0.15 times, a circumference of the female thread of the inside of the closure cap, on which the female thread segment is arranged.

5. The multi-component closure according to claim 4, wherein a length of the male thread segment corresponds to 0.25 to 0.45 times a neck circumference, or to 0.27 to 0.35 times the neck circumference.

6. The multi-component closure according to claim 1, wherein the at least one first locking element comprises a male thread segment and the at least one second locking element comprises a female thread segment, where the female thread segment essentially is arranged facing the hinge.

7. The multi-component closure according to claim 1, wherein the at least one first locking element comprises a connection male thread segment, which connects to the at least one male thread segment and is designed to guide, during a rotational movement of the closure cap, the at least one female thread segment into the male thread segment;

and optionally wherein a pitch of the connection male thread segment differs from the first pitch, in particular is smaller than the first pitch;

and optionally wherein a pitch of the connection male thread segment changes.

8. The multi-component closure according to claim 4, further comprising a latch cam, which is arranged close to the respective end in the male thread segment and is designed to engage in a closed state of the closure cap in a notch of the female thread segment.

9. The multi-component closure according to claim 4, further comprising a notch, which is arranged close to the respective end in the male thread segment and is designed to cooperate in a closed state of the closure cap with a latch cam in the female thread segment.

10. The multi-component closure according to claim 1, where the at least one first locking element and the at least one second locking element form a bayonet catch.

11. The multi-component closure according to claim 10, wherein the at least one first locking element comprises a plurality of longitudinal slots, at each end of which perpendicularly connects a transversal slot, and the at least one second locking element comprises a plurality of knobs, optionally on an inside surface of the closure cap, which is arranged in such a way, that they engage during a defined longitudinal movement and a subsequent rotational movement of the closure cap in a first direction opposite a second direction in the longitudinal slots and dedicated transversal slots; and optionally wherein the plurality of longitudinal slots are arranged symmetrically around the neck.

12. The multi-component closure according to claim 1, wherein the at least one first locking element comprises two longitudinal slots with each following a transversal slot in a rectangular manner, and the at least one second locking element comprises a plurality of knobs arranged with respect to a respective axis of symmetry through a central point of the closure cap essentially perpendicular to the hinge and/or the two longitudinal slots facing each other;

and/or wherein the plurality of longitudinal slots starting from the neck opening extend in a direction of the support and the plurality of longitudinal slots open towards the neck opening.

13. The multi-component closure according to claim 11, wherein the plurality of longitudinal slots comprises a width, which at least corresponds with an extension of the knobs and optionally comprises, in the region of the neck opening, a width increasing towards the neck opening;

and/or further comprising a latch cam, which is arranged at an interface of the longitudinal slots to the transversal slot, such that the latch cam prevents a play along the first direction or the second direction in closed state;

and/or wherein a length of the knobs essentially corresponds to a length of the transversal slots.

14. The multi-component closure according to claim 1, wherein the closure cap comprises a sealing ring, which in a closed state of the closure cap engages in the neck opening in a liquid-tight manner;

and optionally wherein the sealing ring comprises an outer diameter, which is slightly larger than the neck opening;

and/or optionally wherein the neck opening comprises an inwardly curved flap.

15. The multi-component closure according to claim 14, wherein the sealing ring comprises a height, which increases with increasing distance from the hinge; and/or optionally wherein the height of the sealing ring is designed such that, in a cross section along a plane passing through the hinge and a mid-point of the closure cap, a first section of the sealing ring facing the hinge has a lower height than a second section of the sealing ring facing away from the hinge;

and/or optionally wherein a side of the sealing ring facing the neck opening is shorter than an inner side of the sealing ring.

16. The multi-component closure according to claim 1, wherein the hinge comprises a flexible joint arranged between the retaining ring and the closure cap.

17. The multi-component closure according to claim 1, wherein the hinge comprises a first hinge flap, which constitutes a part of the retaining ring and comprises a second hinge flap, which forms a part of the closure cap;

and/or wherein the hinge is designed to keep in an open and/or in a swung-out state the closure cap in an angle of at least 90° rotated around the hinge, optionally in a range from 115° to 145°, optionally larger than 120° rotated around the hinge.

18. The multi-component closure according to claim 16, wherein the hinge comprises at least a snap element, which is designed to keep, when a predefined rotation angle of the closure cap around the flexible joint is exceeded, in the range from 80° to 100°, the closure cap above the predefined rotation angle; and optionally wherein the at least one snap element is located in a recess of the retaining ring, and an axis of rotation of the flexible joint extends above this recess.

19. The multi-component closure according to claim 14, wherein the flexible joint extends at a height of a lower edge of the sealing ring, optionally in a range from 1 mm to 3 mm around the lower edge of the sealing ring.

20. The multi-component closure according to claim 1, where the neck opening has a smaller outer diameter than an underside of the neck, optionally in a range of the retaining ring;

and/or wherein the closure cap comprises on a circumferential side a fluting with vertically extending webs, wherein a number of webs per unit length varies optionally;

and/or wherein the support has a welding edge, which is spaced apart from the neck opening and runs around the neck opening.

21. The multi-component closure according to claim 1, wherein the flexible joint is designed as one piece with the retaining ring and the closure cap.

* * * * *